US007351024B2

(12) United States Patent
Parker

(10) Patent No.: US 7,351,024 B2
(45) Date of Patent: Apr. 1, 2008

(54) APPARATUS AND METHOD FOR BINDING A BOOK

(75) Inventor: Kevin P. Parker, Berkeley, CA (US)

(73) Assignee: Powis Parker Inc., Berkeley, CA (US)

( * ) Notice: Subject to any disclaimer, the term of this patent is extended or adjusted under 35 U.S.C. 154(b) by 345 days.

(21) Appl. No.: 10/670,749

(22) Filed: Sep. 25, 2003

(65) Prior Publication Data

US 2004/0120793 A1 Jun. 24, 2004

(51) Int. Cl.
*B42C 9/00* (2006.01)

(52) U.S. Cl. ..... 412/8; 412/6; 412/28; 412/33; 412/900; 412/901; 412/902

(58) Field of Classification Search ..... 412/1, 412/6, 8–9, 22, 24–25, 28, 33, 900–902; 281/21.1, 29, 34

See application file for complete search history.

(56) References Cited

U.S. PATENT DOCUMENTS

| | | | | |
|---|---|---|---|---|
| 2,294,347 | A | 8/1942 | Bauer | 154/46 |
| 3,080,178 | A | 3/1963 | Brody | 281/34 |
| 3,367,680 | A | 2/1968 | Greenspan | 281/37 |
| 3,532,363 | A | 10/1970 | Abildgaard et al. | 281/29 |
| 3,608,115 | A | 9/1971 | Chou et al. | 412/19 |
| 3,715,260 | A | 2/1973 | Dornemann et al. | 156/477 B |
| 3,749,422 | A | 7/1973 | Abildgaard et al. | 281/21 |
| 3,816,866 | A | 6/1974 | Miaskoff et al. | 11/3 |

(Continued)

FOREIGN PATENT DOCUMENTS

| | | | |
|---|---|---|---|
| CA | 991219 | 6/1976 | 281/6 |

(Continued)

OTHER PUBLICATIONS

PCT Publication No. WO 99/39917, Publication Date Aug. 12, 1999.

(Continued)

*Primary Examiner*—Monica Carter
*Assistant Examiner*—Eric A. Gates
(74) *Attorney, Agent, or Firm*—Girard & Equitz LLP

(57) ABSTRACT

A book binding apparatus for binding a stack of sheets, including a cover element having a first cover section that corresponds to the dimensions of the sheets and a first section of pressure sensitive adhesive and an associated release liner disposed along a first edge of the first cover section. A flap member is attached to the first cover section and is movable between a closed position disposed over the first pressure sensitive adhesive layer and an open position moved away from the layer. A second adhesive layer and associated release liner is disposed on an inner surface of the flap member. The binding apparatus may be used in combination with second cover section and associated binder spine element having heat activated adhesive to bind the stack of sheets. The spine element is folded around the edge of the stack to be bound and is secured in place by the first section of pressure sensitive adhesive. The flap member is the secured in the closed position by the second adhesive layer, with heat then being applied to the spine element so that the edge of the stack will be bound by the heated adhesive.

17 Claims, 31 Drawing Sheets

U.S. PATENT DOCUMENTS 3,825,963 A 7/1974 Abildgaard et al. ..... 412/21
3,847,718 A 11/1974 Watson ..... 161/39
3,912,304 A * 10/1975 Abildgaard et al. ..... 281/21.1
3,964,770 A 6/1976 Abildgaard et al. ..... 281/29
RE29,105 E 1/1977 Miaskoff et al. ..... 11/3
4,126,982 A 11/1978 Ito et al. ..... 53/593
4,129,914 A 12/1978 Jahn ..... 11/2
4,184,218 A 1/1980 Hawkes ..... 11/1 AD
4,299,410 A 11/1981 Jukola ..... 281/21 R
4,314,716 A 2/1982 Errichiello ..... 281/29
4,367,061 A 1/1983 Wilholm ..... 412/3
4,377,430 A 3/1983 Bexley et al. ..... 156/184
4,385,225 A * 5/1983 Giulie ..... 219/521
4,420,282 A 12/1983 Axelrod ..... 412/4
4,496,617 A 1/1985 Parker ..... 428/55
4,511,298 A * 4/1985 Jones ..... 412/34
4,537,544 A 8/1985 Joost ..... 412/5
4,615,541 A 10/1986 Kwauka ..... 281/29
4,650,216 A 3/1987 Carlson ..... 281/34
4,762,341 A * 8/1988 Rabuse ..... 281/29
4,800,110 A 1/1989 DuCorday ..... 428/43
4,898,506 A 2/1990 Lázár ..... 412/8
4,906,156 A * 3/1990 Axelrod ..... 412/21
5,011,187 A 4/1991 Hunder et al. ..... 281/15.1
5,013,200 A 5/1991 Hunder et al. ..... 412/6
5,044,857 A 9/1991 Crudo ..... 412/19
5,052,872 A * 10/1991 Hunder et al. ..... 412/6
5,052,873 A 10/1991 Parker et al. ..... 412/13
5,066,183 A 11/1991 Tholérus ..... 412/4
5,078,563 A 1/1992 Lolli ..... 412/8
5,154,447 A 10/1992 Tooker ..... 281/21.1
5,174,556 A 12/1992 Taylor et al. ..... 270/1.1
5,193,962 A 3/1993 Parker et al. ..... 412/8
5,340,155 A 8/1994 Podosek ..... 281/29
5,346,350 A 9/1994 Luhman et al. ..... 412/37
5,364,215 A 11/1994 Snellman et al. ..... 412/3
5,452,920 A 9/1995 Parker ..... 281/21.1
5,569,011 A 10/1996 Yamaguchi et al. ..... 412/9
5,601,312 A 2/1997 Funkhouser ..... 281/21.1
5,601,915 A 2/1997 Ochi et al. ..... 428/323
5,605,425 A 2/1997 Schaefer ..... 412/4
5,613,711 A 3/1997 Parker ..... 281/21.1
5,683,111 A 11/1997 Bass et al. ..... 281/21.1
5,727,816 A * 3/1998 Ong ..... 281/29
5,779,423 A 7/1998 Bermingham ..... 412/4
5,829,938 A 11/1998 Hartwig et al. ..... 412/8
5,833,423 A 11/1998 Yamaguchi et al. ..... 412/8
5,997,964 A 12/1999 Klima, Jr. ..... 428/1
6,010,157 A * 1/2000 Pierson et al. ..... 281/21.1
6,024,525 A 2/2000 Yamanaka ..... 412/36
6,056,493 A 5/2000 Hartwig et al. ..... 412/8
6,065,884 A 5/2000 Parker et al. ..... 400/611
6,155,763 A 12/2000 Parker et al. ..... 412/6
6,158,776 A * 12/2000 Purcocks ..... 281/21.1
6,174,120 B1 1/2001 Kalisher ..... 412/1
6,322,867 B1 11/2001 Rush et al. ..... 428/40.1
6,332,630 B1 * 12/2001 Wolff et al. ..... 281/29
6,530,339 B1 3/2003 Silverbrook ..... 118/46
6,599,074 B2 7/2003 Parker ..... 412/33
6,619,900 B2 9/2003 Cobene, II et al. ..... 412/1
6,632,060 B1 10/2003 Gilmore et al. ..... 412/9
6,641,345 B2 11/2003 Cobene, II et al. ..... 412/1
6,685,415 B2 2/2004 Rush et al. ..... 412/37
6,709,727 B1 3/2004 Parker ..... 428/40.1
7,134,822 B2 11/2006 Parker et al. ..... 412/19
2002/0064437 A1 5/2002 Kuramoto et al.
2004/0066029 A1 4/2004 Parker
2004/0066030 A1 4/2004 Parker
2004/0120794 A1 6/2004 Parker
2006/0034672 A1 2/2006 VanDeWalle et al.
2006/0083604 A1 4/2006 Parker
2006/0115347 A1 6/2006 Parker

FOREIGN PATENT DOCUMENTS

EP 0404751 A1 12/1990
JP 403227698 A 10/1991 ..... 312/184

OTHER PUBLICATIONS

Seal and View® "Clear Label Protectors" Self Adhesive Stock No. CLL manufactured by Smead, Hastings Minnesota. (Admitted Prior Art).

* cited by examiner

APPARATUS AND METHOD FOR BINDING A BOOK

BACKGROUND OF THE INVENTION

1. Field of the Invention

The present invention relates generally to the field of bookbinding, and more particularly, to a bookbinding structure and method that can be used to bind a book with low cost desktop binding equipment.

2. Description of Related Art

Bookbinding systems in the form of binding folders or covers having various forms of adhesive for binding stacks of sheets are well known in the art. A typical conventional thermal binding cover system, such as disclosed in U.S. Pat. No. 3,833,244, requires different sized covers to accommodate stacks of sheets of varying thickness. Thus, a user must maintain a substantial inventory of different sized covers, a definite disadvantage. In order to reduce the amount of inventory, there have been some attempts to provide a binding folder that is capable of accommodating a wide range of stack thickness. By way of example, U.S. Pat. No. 4,371,194 discloses a single size book cover structure that is capable of binding stacks of varying thickness. However, the outer edge of one of the covers of the cover structure must be folded over on itself so as to adjust to the varying stack thickness. The result is a relatively unattractive bound book.

There is a need for a book binding structure that is capable of accommodating stacks of varying thickness so as to reduce the need for maintaining a large inventory and yet provide a bound book having a pleasing appearance that approaches that of a professionally bound book. It is also desirable that the binding structures require only a simple desktop binder that provides little more than heating capability. The present invention meets these and other requirements as will be apparent to those skilled in the art upon a reading of the following Detailed Description of the Invention together with the drawings.

SUMMARY OF THE INVENTION

A book binding apparatus for binding a stack of sheets is disclosed. One embodiment of the apparatus includes a first cover element having a first cover section, typically made of heaving paper, which is dimensioned to correspond to the sheets of the stack to be bound. A first section of pressure sensitive adhesive is disposed along a first edge of the cover section, with a first release liner being positioned above the pressure sensitive adhesive.

A flap member is also attached to the first cover section and is movable between a closed position and an open position. When in the closed position, the flap member is positioned over at least a portion of the first release liner and when in the open position, the flap member is positioned away from the first release liner. The apparatus further includes a second section of pressure sensitive adhesive disposed on a surface of the flap member that faces the first release liner. A second release liner is disposed over the second section of pressure sensitive adhesive. The subject binding apparatus can be used in combination with a second cover element having a spine element with a heat activated adhesive to bind the stack, with the spine element being held in place adjacent the edge of the stack by the first section of pressure sensitive adhesive.

Further, a method of binding a stack of sheets is disclosed. In one embodiment, a cover element is provided which includes a cover section having dimensions that generally correspond to those of the stack of sheets to be bound. An elongated binder spine element having a longitudinal first edge is attached to a first edge of the cover section. The spine element includes a substrate having a matrix of heat activated adhesive. The first cover element and the stack of sheets are positioned relative to one another so that the cover section is disposed adjacent a first side to the stack of sheets. The spine element is folded around the edge of the stack to be bound so that the adhesive matrix is facing the stack edge. A second longitudinal edge of the spine element is secured so that the spine element remains folded around the edge of the stack. The securing is typically carried out using a pressure sensitive adhesive. Heat is then applied to the spine element so as to activate the adhesive and bind the edge of the stack.

DETAILED DESCRIPTION OF THE INVENTION

Figure 1:
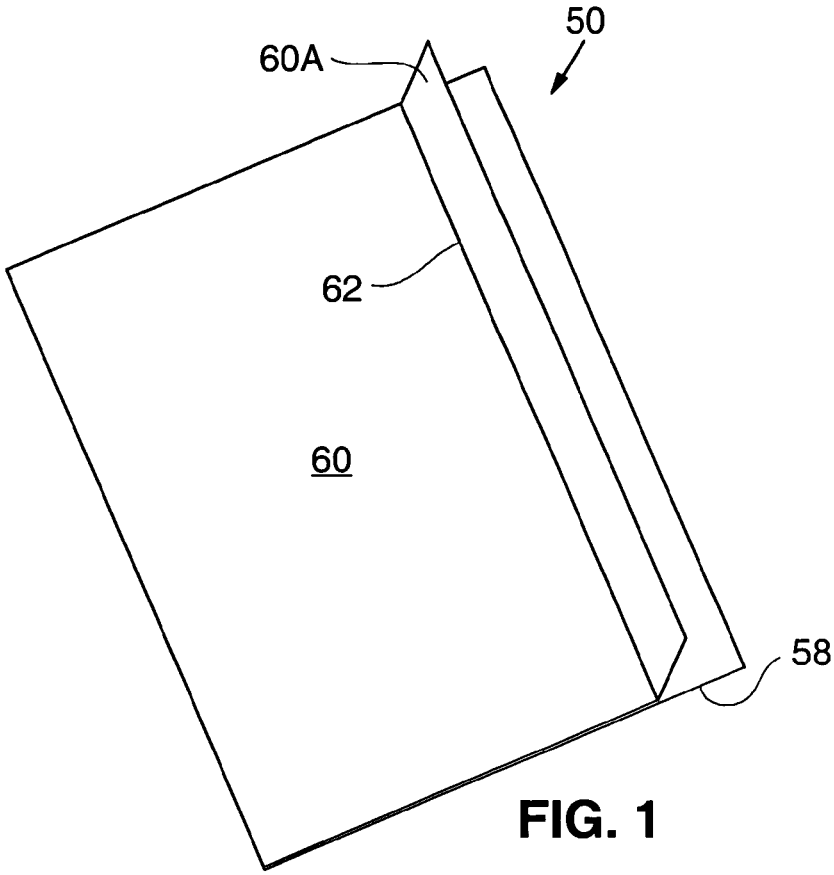
FIG. 1 is a perspective view of the back cover element of a first embodiment of the subject binding apparatus.
Figure 2:
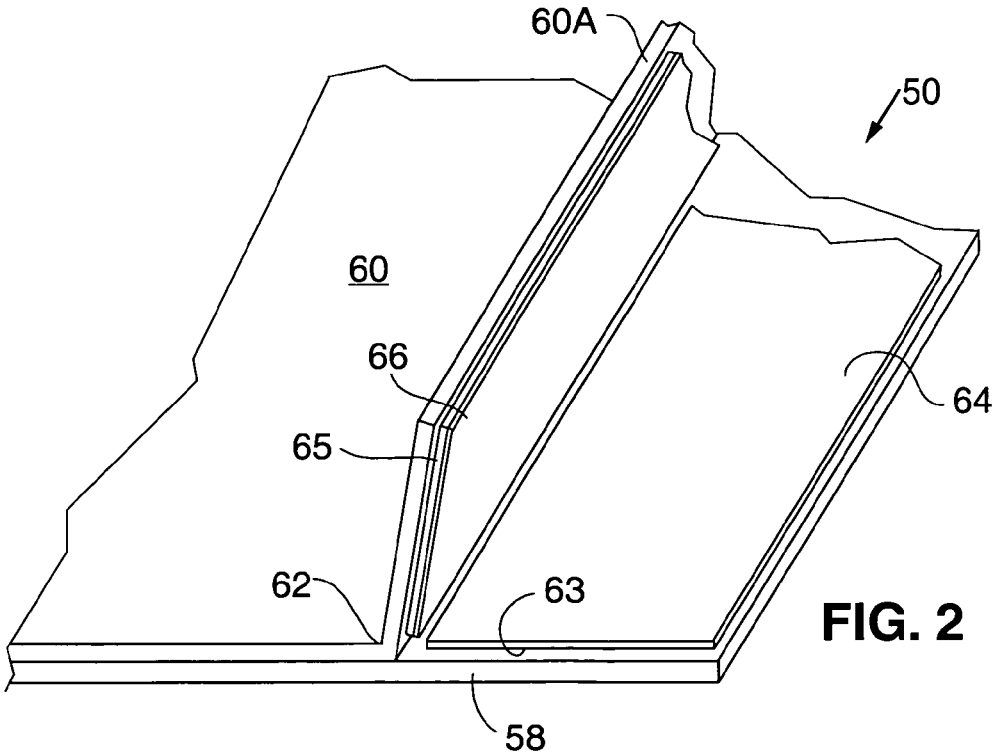
FIG. 2 is an expanded view of a portion of the FIG. 1 back cover element showing details of the flap member.
Figure 3:
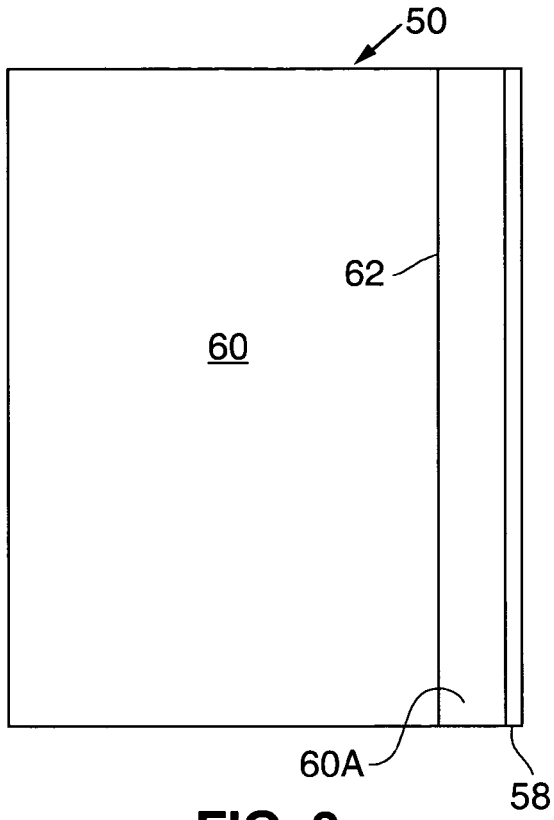
FIG. 3 is a plan view of the first embodiment back cover element.
Figure 4:
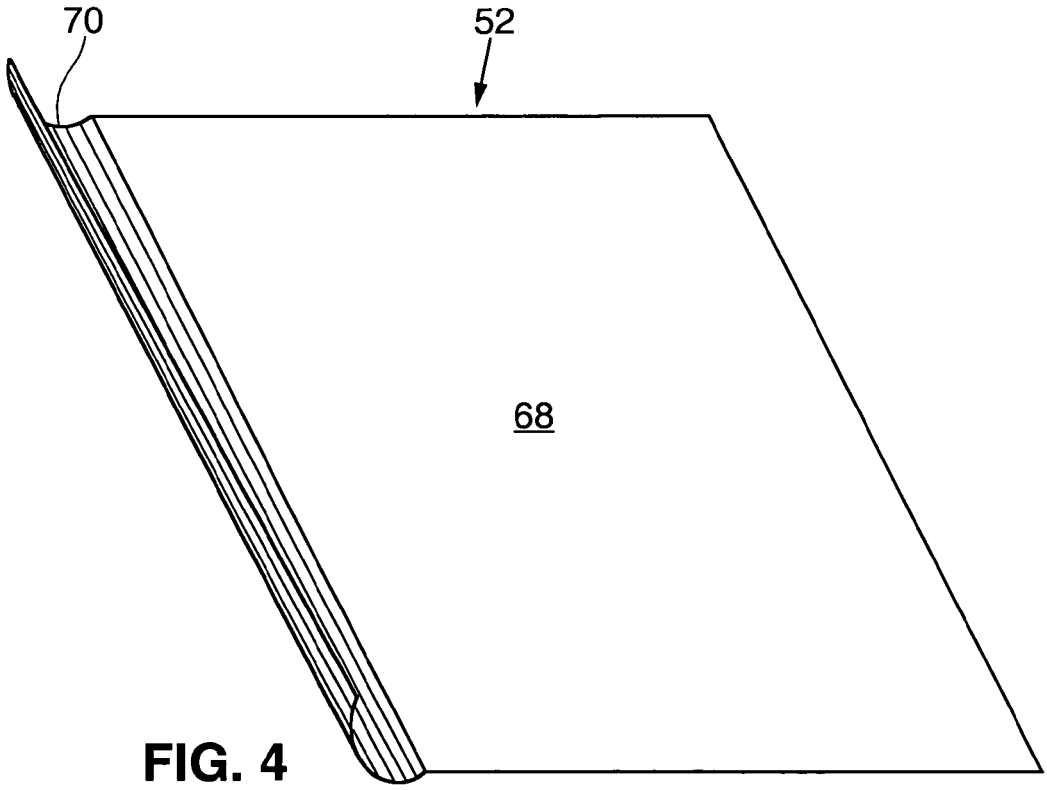
FIG. 4 is a perspective view of the front cover element of the subject binding apparatus
Figure 5:
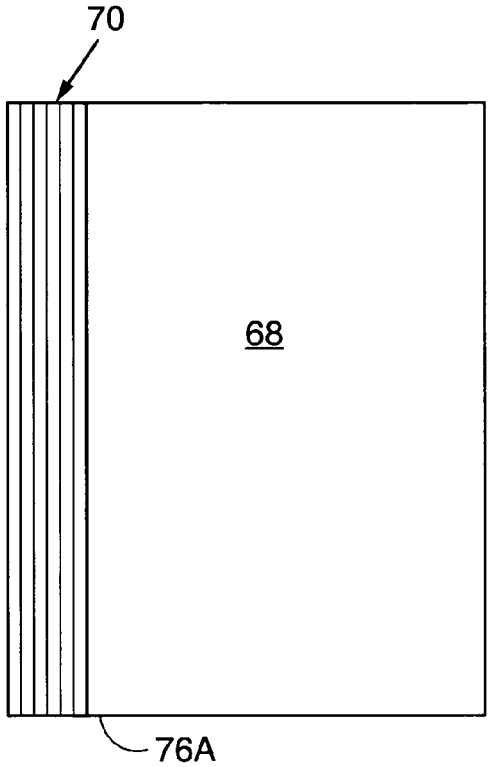
FIG. 5 is a plan view of the front cover element.
Figure 6:
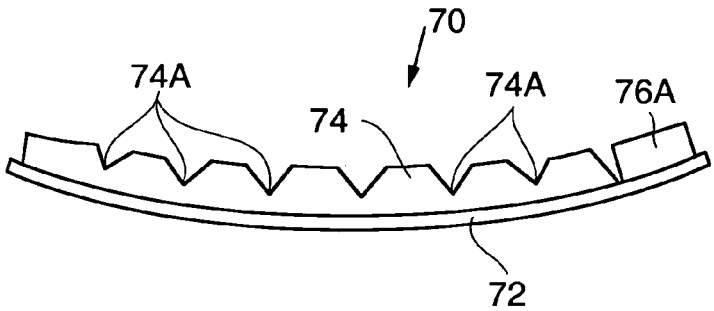
FIG. 6 is a side view of the spine element of the front cover element.
Figure 7:
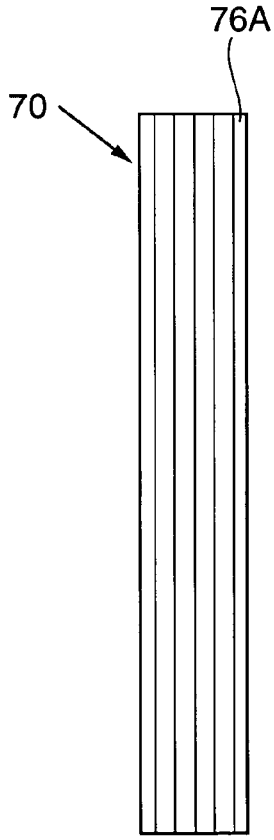
FIG. 7 is a plan view of the spine element of the front cover element.

Referring to the drawings, a first embodiment of the subject binding apparatus includes a back cover element 50 as shown in FIGS. 1-3 and a front cover element as shown in FIGS. 4-7. The present invention will be described in connection with the binding of a stack of 8½ by 11 inch sheets, it being apparent that the dimensions will need to be adjusted to accommodate sheets of other sizes. The back cover element 50 is preferably made from two sheets of heavy paper such as Bristol vellum, 80 lb. A bottom sheet 58 (FIG. 2) is 8½ by 11 inches, with a top sheet 60 made of the same material being 8¼ by 11 inches. The top sheet 60 is folded to form a flap member 60A, with the flap member width, the distance between the fold line 62 and the edge of the flap member being 1⅜ inches. The first embodiment back cover element 50 is formed by gluing the bottom 58 and top sheets 60 together, with the exception of the flap member 60A, to form a single sheet.

As can best be seen in FIG. 2, a segment 65 of pressure sensitive adhesive extends along essentially the full length of the underside of the flap member 60A. The adhesive 65 is covered by a removable release liner 66. An adhesive sold by National Starch and Chemical Company under the designation Instant Lok HL PSA 20-81 has been found suitable for this application, as is a release liner sold by Technicote under the designation L42. Another segment 63 of pressure sensitive adhesive is disposed on the bottom sheet 58, below the flap member 60A when the flap member is folded over the bottom sheet, extending substantially the full length of the bottom sheet. A release liner 64 is positioned above the adhesive 63 on the bottom sheet 58.

Referring now to FIGS. 4-7, the front cover element 52 includes an 8½ by 11 inch sheet of material, which in one embodiment is a transparent plastic sheet 68. A spine element 70 is included having a fabric substrate (FIG. 6) which is 1¾ inches wide and 11 inches long. A heat activated adhesive matrix is disposed on the surface of the substrate, including a central adhesive region 74 and an outer adhesive region 76A. Suitable adhesives are sold by HB Fuller under the designations HL 1330 for adhesive 74 and HL 1777 for adhesive 76. Preferably, an undercoat adhesive (not depicted) is disposed between adhesives 74 and 76 and the underlying substrate 72. Notches or grooves 74A are formed in the relatively thick, typically 0.015 inches, center adhesive 74 every 1/16 of an inch (only some of the notches are depicted) to increase the flexibility of the spine element so that it can be easily wrapped around the edge of stacks of sheets of varying thickness, as will be explained. One longitudinal edge of the spine element 70 is secured to an edge of sheet 68 by way of outer adhesive region 76A.

Figure 8A:
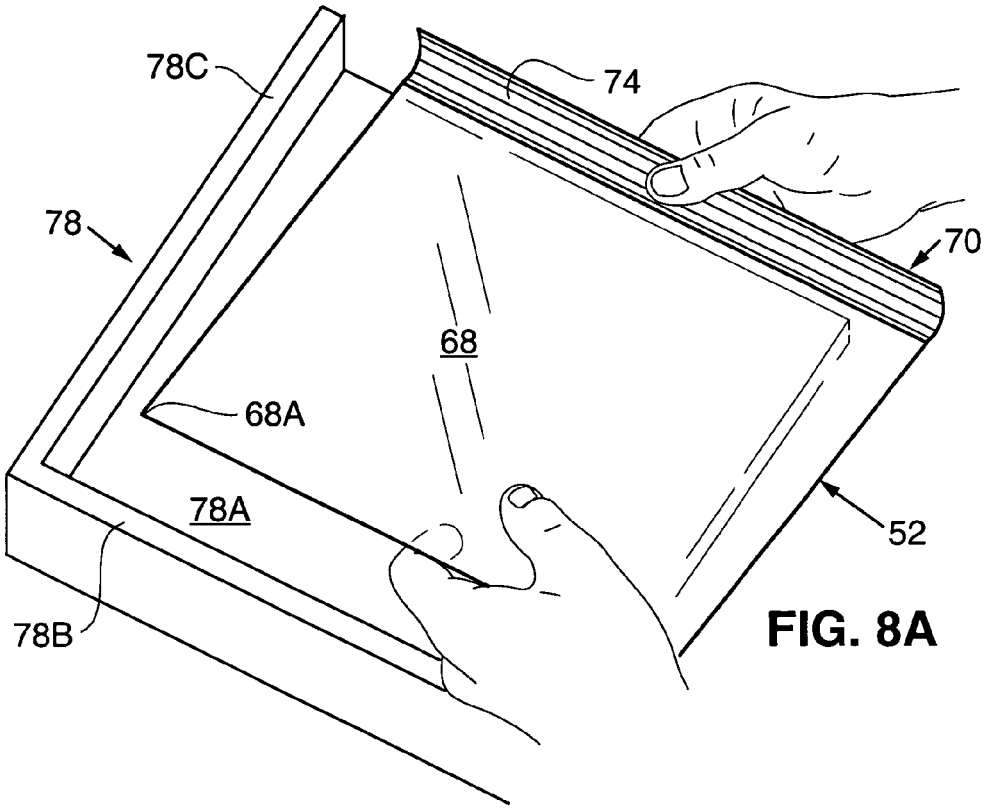
FIGS. 8A-8K depict a sequence for binding a stack of sheets in accordance with the first embodiment of the present invention.

The manner in which the binding apparatus is used to bind a stack of sheets will now be described in connection with FIGS. 8A-8K. No special tools are needed to bind a stack of sheets other than a simple guide apparatus and a conventional heating unit. As can be seen in FIG. 8A, the guide apparatus 78 includes a work surface 78A and two orthogonal wall members 78B and 78C which extend up from that work surface about one inch. First, a front cover element 52 is positioned on the work surface 78A with the spine element 70 positioned opposite wall member 78B, with the adhesive 74 facing upward. The corner 68A of sheet 68 is positioned at the intersection of wall members 78B and 78C so that the two orthogonal edges of sheet 68 abut the respective wall members.

Figure 8B:
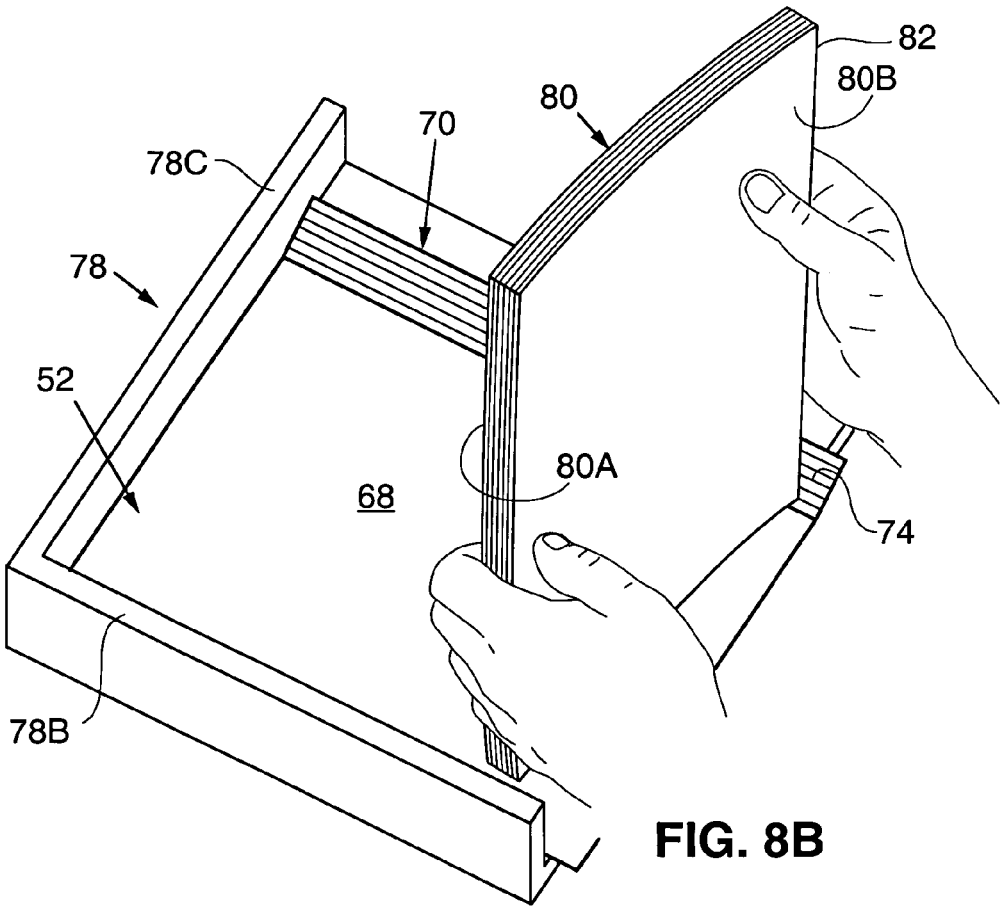
Figure 8C:
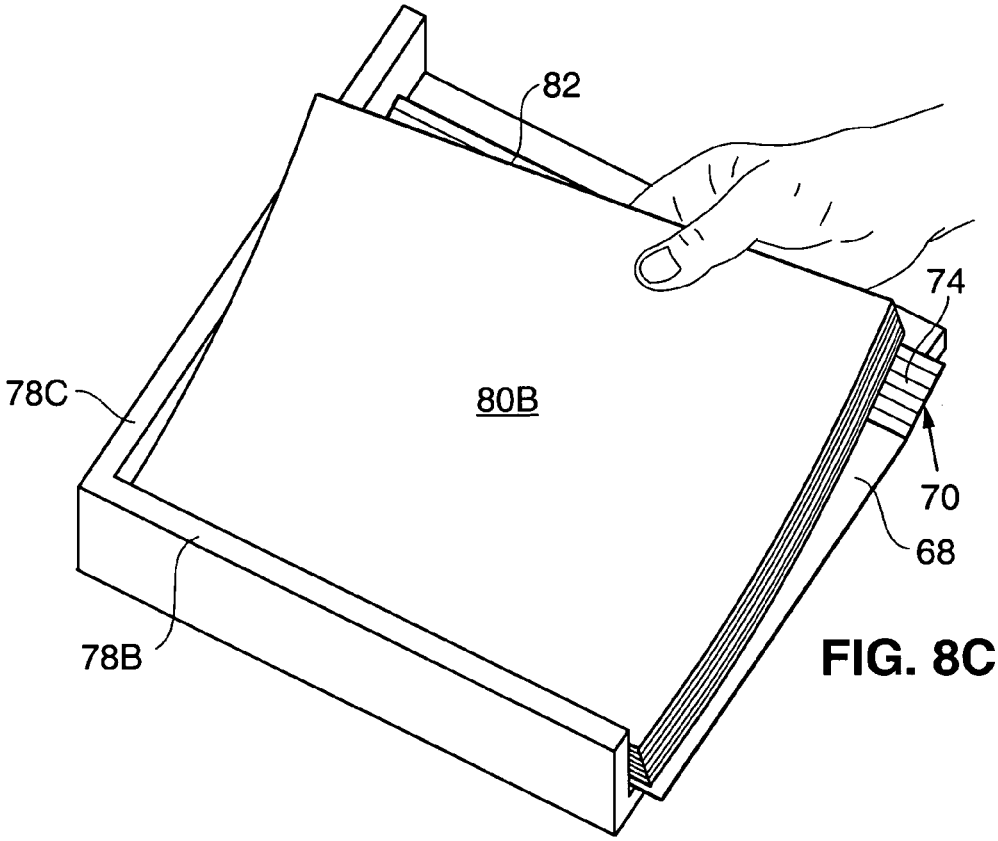

Referring to FIGS. 8B and 8C, once the front cover element is properly positioned, the stack of sheets 80 to be bound is positioned over the front cover element 52. Prior to positioning, the stack 80 should be thoroughly jogged so that the sheets are all aligned with one another. The edge 82 of the stack 80 that will form the spine is positioned adjacent the spine element 70, with the last page 80B of the stack on top. The respective edges of the stack 80 should abut the respective wall members 78B and 78C. Since sheet 68 of the front cover element in the present exemplary embodiment is transparent, any title information can be printed on the first page 80A of the stack. Of course, sheet 68 need not be transparent in other embodiments of the subject invention. It has been found that the stack 80 thickness can range from 3 to 200 pages for the spine element 70 dimensions note above.

Figure 8D:
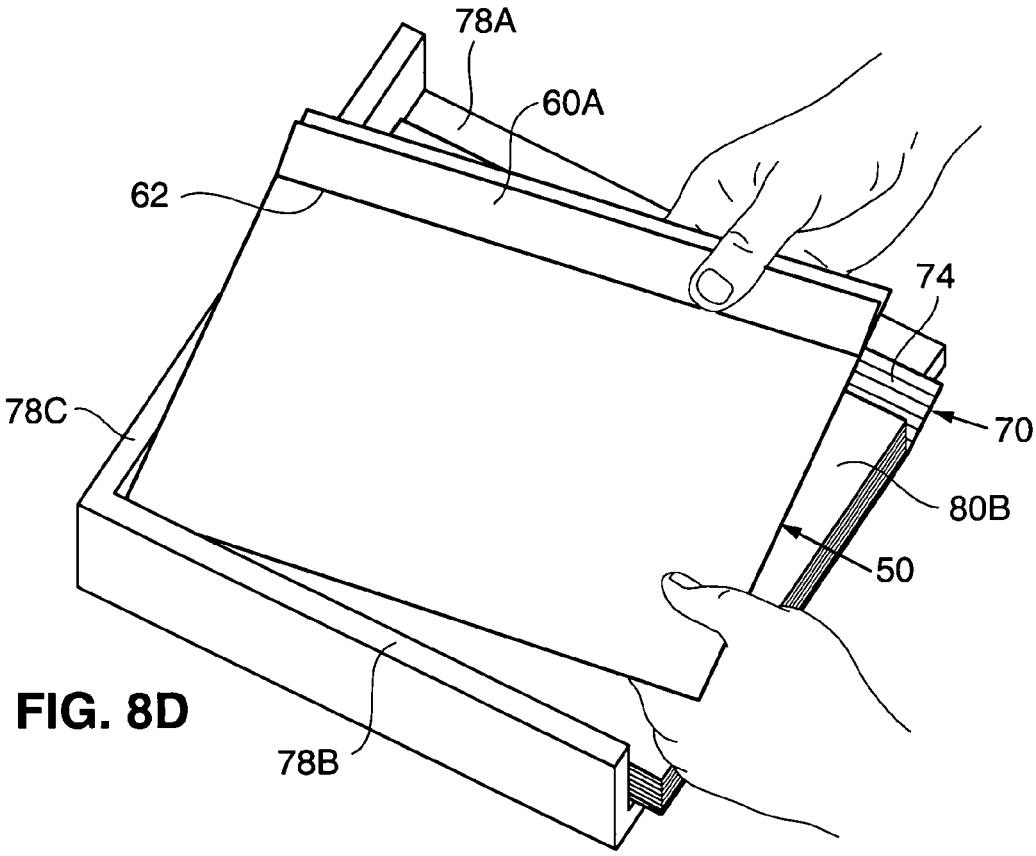
Figure 8E:
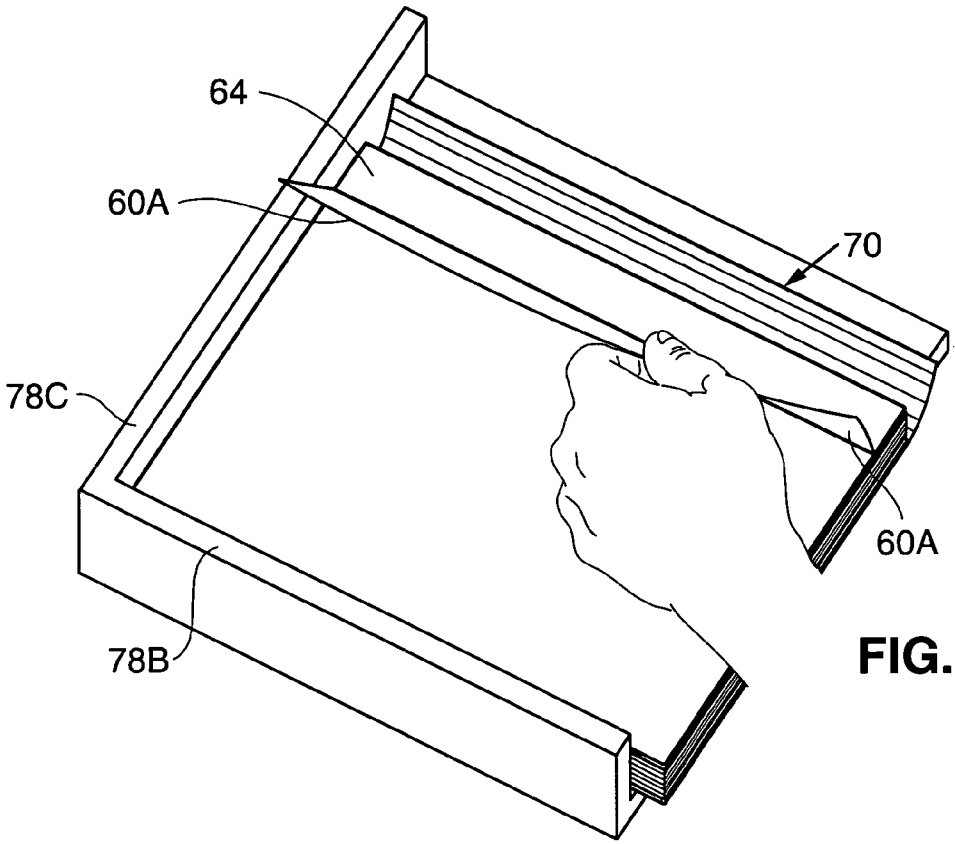
Figure 8F:
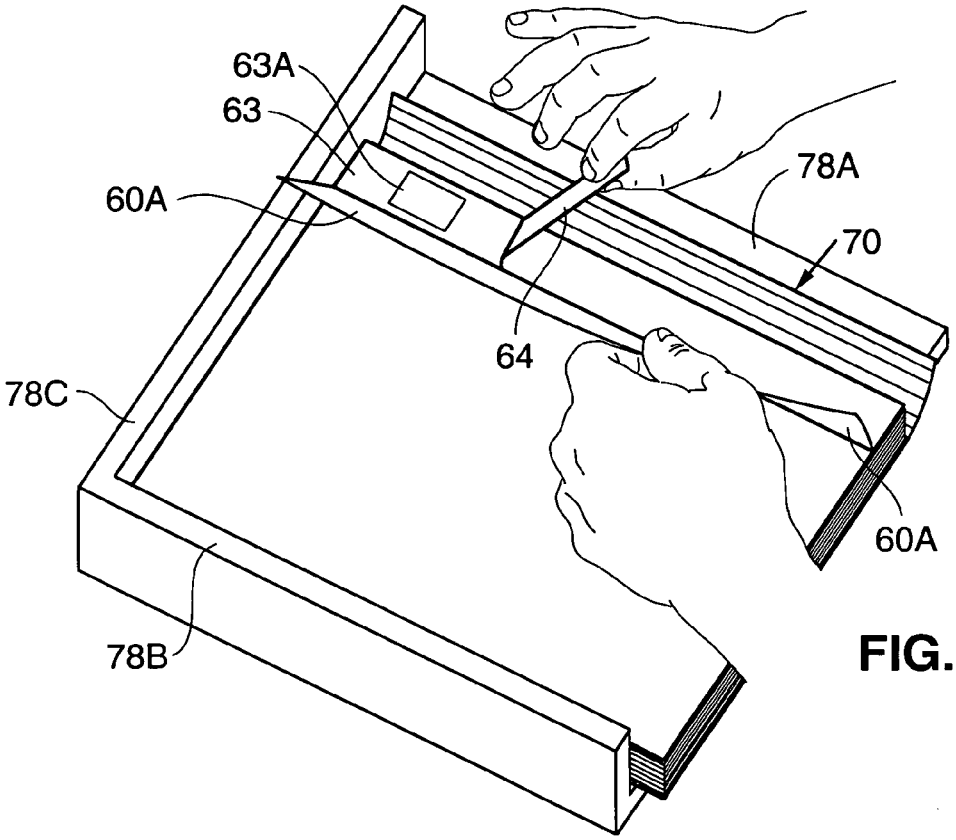

Once the stack 80 has been properly positioned, the back cover element 50 is positioned over the stack as shown in FIG. 8D. Again, care is taken to be ensure that the edges of the cover element 50 abut the respective wall members 78B and 78C of the guide apparatus. As shown in FIG. 8E, the flap member 60A is lifted up and rotated around fold line 62 (FIG. 2) so as to expose release liner 64. Release liner 64 is then removed as shown in FIG. 8F. The user then lifts the spine element 70 portion of back cover element 50 and wraps the spine element tightly around the edge 82 (FIG. 8B) of the stack 80 while firmly holding the stack in place, as shown by arrow 87 of FIG. 8G. Preferably, there is are periodic gaps 63A in the adhesive (FIG. 8F) so that a user can place a finger or thumb on the gap, so as to apply downward pressure on the stack with one hand while wrapping the spine element 70 with the other hand. The gaps 63A, typically three in number, are about ¾ of an inch square and are equally spaced along the length of the adhesive. The grooves 74A (FIG. 6) facilitate this folding of the spine element around the longitudinal axis of the spine element.

Figure 8G:
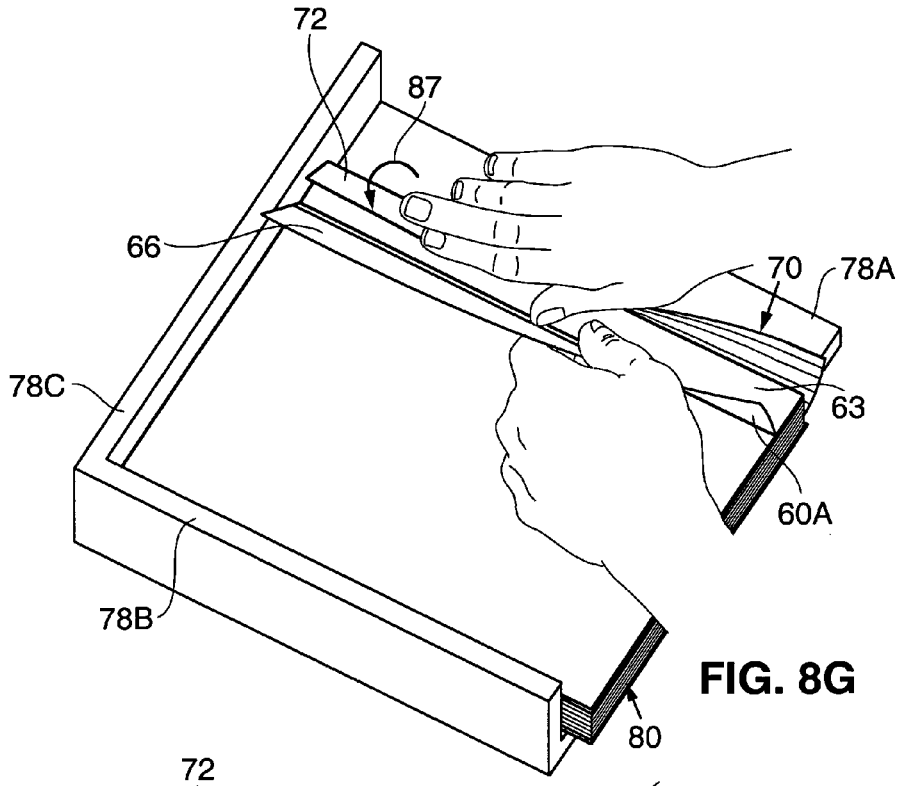

Once the spine element 70 has been tightly wrapped around the edge 82 of the stack along the full length of the stack, the spine element is pressed down on the exposed adhesive 63, along the full length of the spine element, thereby securing the free edge of the spine element to the back cover element 50, as shown in FIG. 8G. The degree to which spine element 70 extends over the adhesive 63 depends upon the thickness of the stack 80, with the thicker stack resulting in the least amount of overlap. Adhesive 63 is sufficiently wide to ensure that the spine element is strongly secured for the thickest stack to be bound, that being about 200 pages in the present embodiment.

Figure 8H:
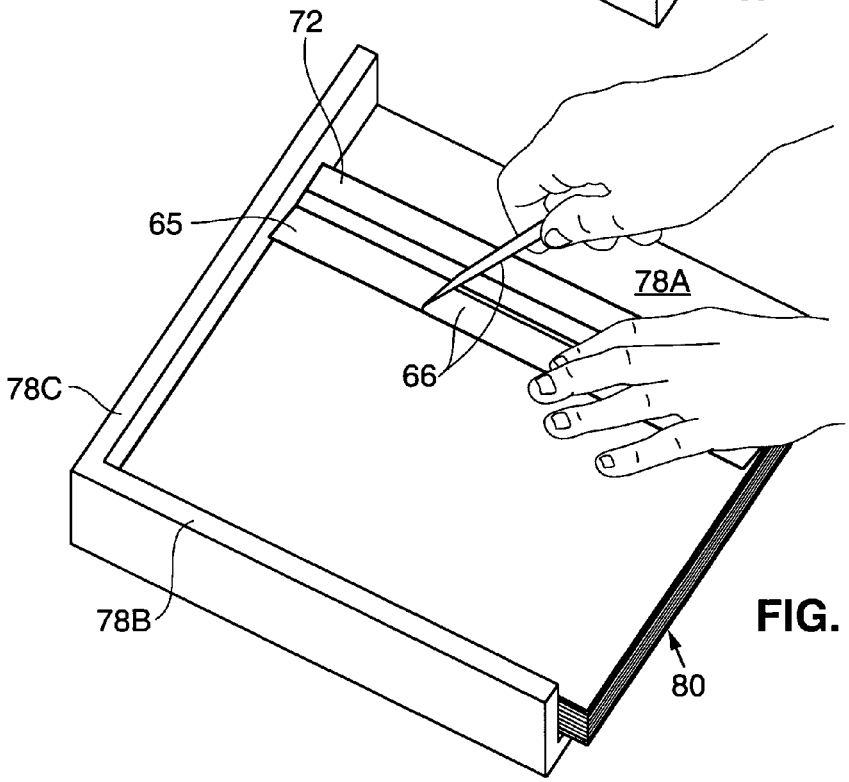
Figure 8I:
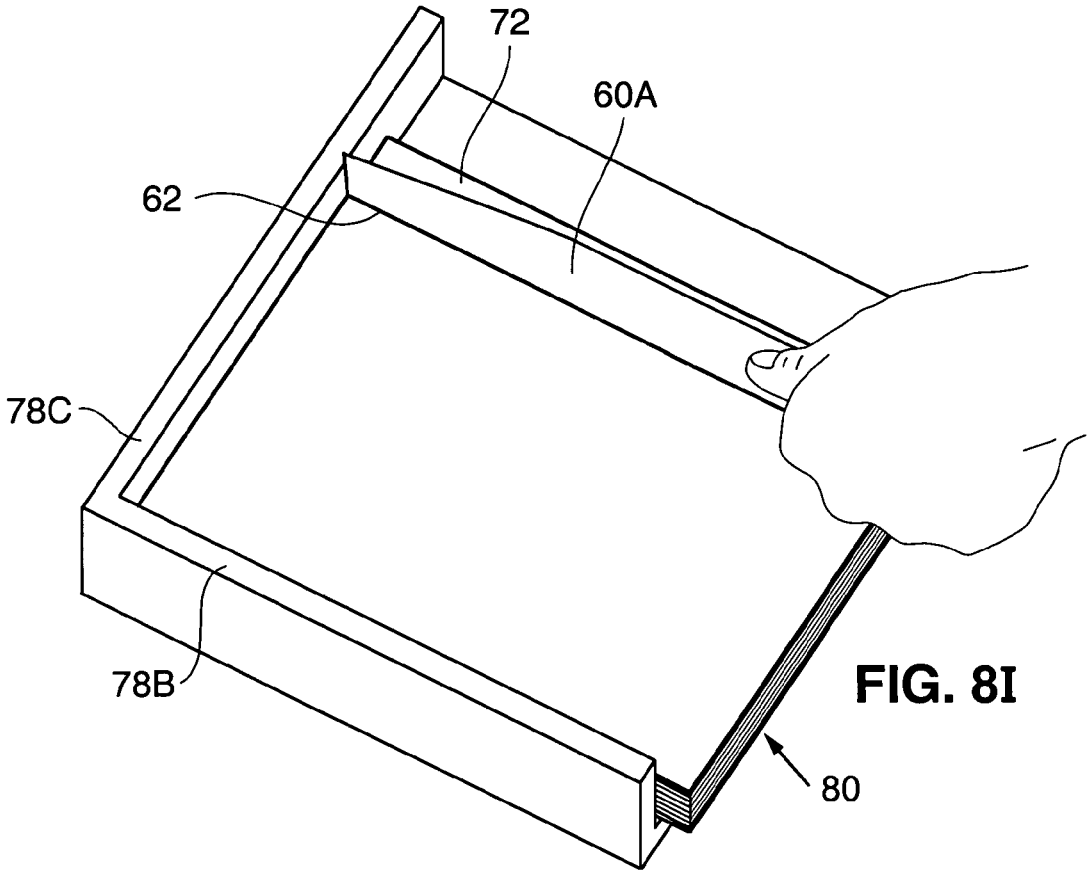
Figure 8J:
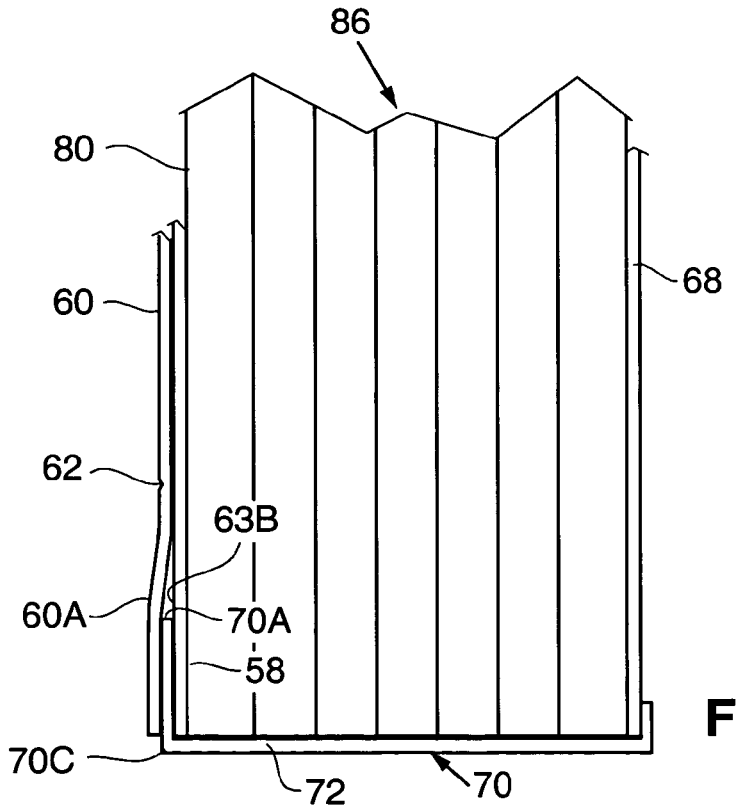

Referring to FIG. 8H, the release liner 66 on the underside of flap member 60A is then removed thereby exposing pressure sensitive adhesive 65. The flap member 60A is then pressed down, securing the flap member to the underlying exposed adhesive 63 and the spine element 70 extension as shown in FIG. 8I. At this point, the front and back cover elements 50 and 52 are secured together by the pressure sensitive adhesives 63 and 65. FIG. 8J is a schematic representation of the book at this point (and not to scale), showing the major components of the back and front cover elements 50 and 52 and the stack 80. As can be seen, extension 70A of the spine element 70, that portion of the element that extends past fold 70C, is disposed in the pocket defined by flap member 60A and bottom sheet 58 of the back cover element 50. The stack 80, which is not yet secured to the front and back cover elements, acts as a form for folding the spine element at the appropriate location 70C, that location being a function of the thickness of the stack. For thinner stacks, extension 70A will extend further into the pocket formed between flap member 60A and bottom sheet 58 and for thicker stacks, the extension will be smaller. Note that in an actual bound book, adhesives 63 and 65 (not depicted) will cause the flap member 60A to adhere directly to the bottom sheet 58 in those locations where the spine element extension 70A is not present, with the open spaces as shown in the FIG. 8J schematic diagram not being present.

Figure 8K:
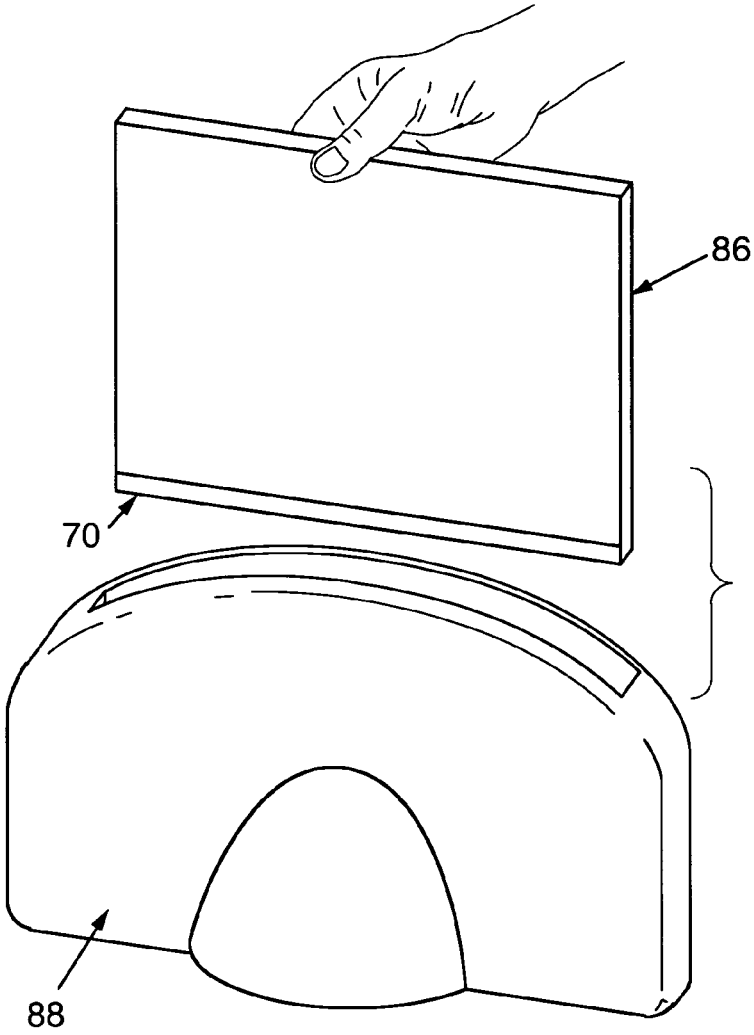
Figure 9:
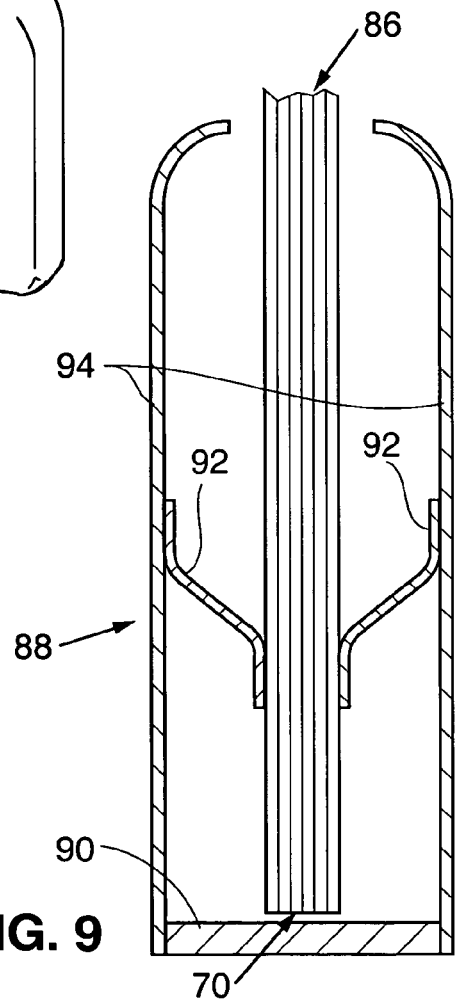
FIG. 9 is a cross-sectional schematic view of a prior art heating fixture for use in the binding sequence step of FIG. 8K.

The combinded stack and binding structure, book 86, is then lifted off the guide apparatus 78, taking care to maintain the relative positions of the stack and binding structure, and inserted into a conventional desktop heating unit 88 as shown in FIG. 8K. One such heating unit is disclosed in U.S. Pat. No. 4,129,471. A suitable heating unit is sold by Pavo under the name Thermomaster. A schematic representation of the heating unit 88 is shown in FIG. 9 and includes a heating element 90 upon which the book 86 rests, with that portion of the spine element 70 at the bottom of the stack resting on the heating element. A pair of book supports 92 is mounted on opposite walls 94 of the heating unit and functions to support book 86 in a vertical position over the heating element 90. Book supports 92 are resilient so as to accommodate books 86 of varying thickness. Typically, heating element is at a temperature range of 320 to 360 degrees F., with the book 86 being heated for approximately 45 seconds. The heat conducted through the fabric substrate 72 will cause adhesive 74 (FIG. 6) melt and to flow up between the sheets of the stack by way of capillary action thereby securing the edges of the sheets together and to the spine element substrate 72. At the end of the heating period, the book is carefully lifted from the heating unit 88 and placed upon a cooling rack, not to be disturbed until the book has cooled.

As previously noted, the first embodiment binding apparatus is capable of binding a stack of widely varying thickness (3-200 sheets). Thus, it is not necessary to maintain an inventory of varying sizes of preformed thermal binding covers. The flap element 60A (FIG. 8J) and associated structure operates to conceal the spine element extension 70A, the length of which may vary depending upon the thickness of the stack, so as to enhance the appearance of the bound book. The flap element 60A and associated structure also conceal any unsightly excess pressure sensitive adhesive 63B as shown in FIG. 8J. The only equipment needed to carry out the binding method is a very simple guide apparatus 78 and a low cost heating unit 88.

Figure 10:
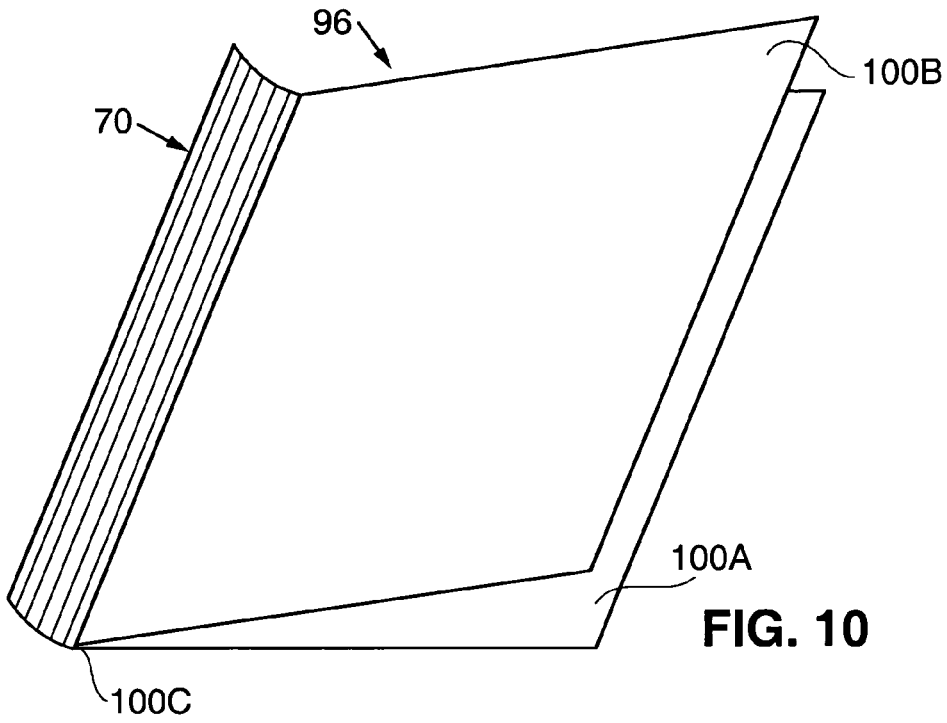
FIG. 10 is a perspective view of a second embodiment front cover element.
Figure 11:
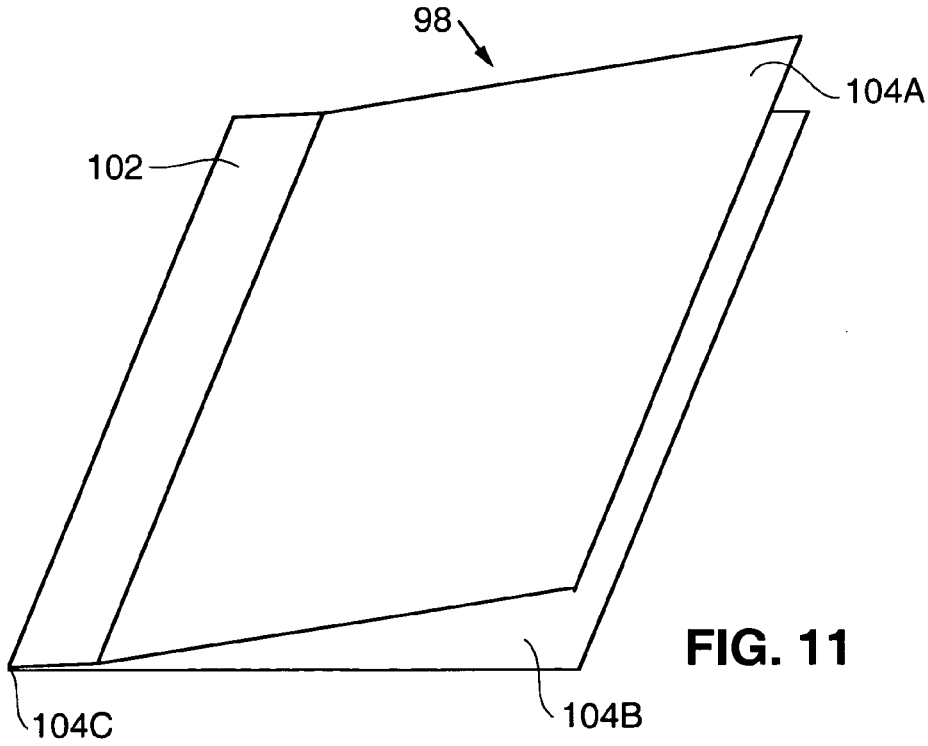
FIG. 11 is a perspective view of a second embodiment back cover element.

A second embodiment of the subject book binding apparatus can be used to create a hardcover book, again using only simple, desktop equipment. The second embodiment apparatus includes a front cover element 96 as shown in FIG. 10 and a back cover element 98 as shown in FIG. 11. The front cover element includes a spine element 70 similar to that used in the first embodiment, having one edge secured to a folded edge 100C of an 11 by 17 inch sheet of 80 pound Bristol vellum or other relatively heavy paper stock. The folded sheet forms an 8½ by 11 inch outer sheet 100A and an 8½ by 11 inch inner sheet 100B. The back cover element 98 of FIG. 11 includes another 11 by 17 inch folded sheet of 80 pound Bristol vellum to form 8½ by 11 inch outer sheet 104A and an 8½ inch inner sheet 104B. A strip of pressure sensitive adhesive (not depicted in FIG. 11), extends along the edge of the outer sheet 104A adjacent the folded edge 104C. The adhesive is approximately 1½ inches wide and is covered by a release liner 102. As was the case of adhesive 63 (FIG. 8F) of the first embodiment apparatus, the adhesive is provided with spaced apart gaps similar to gaps 63A of the first embodiment.

Figure 12A:
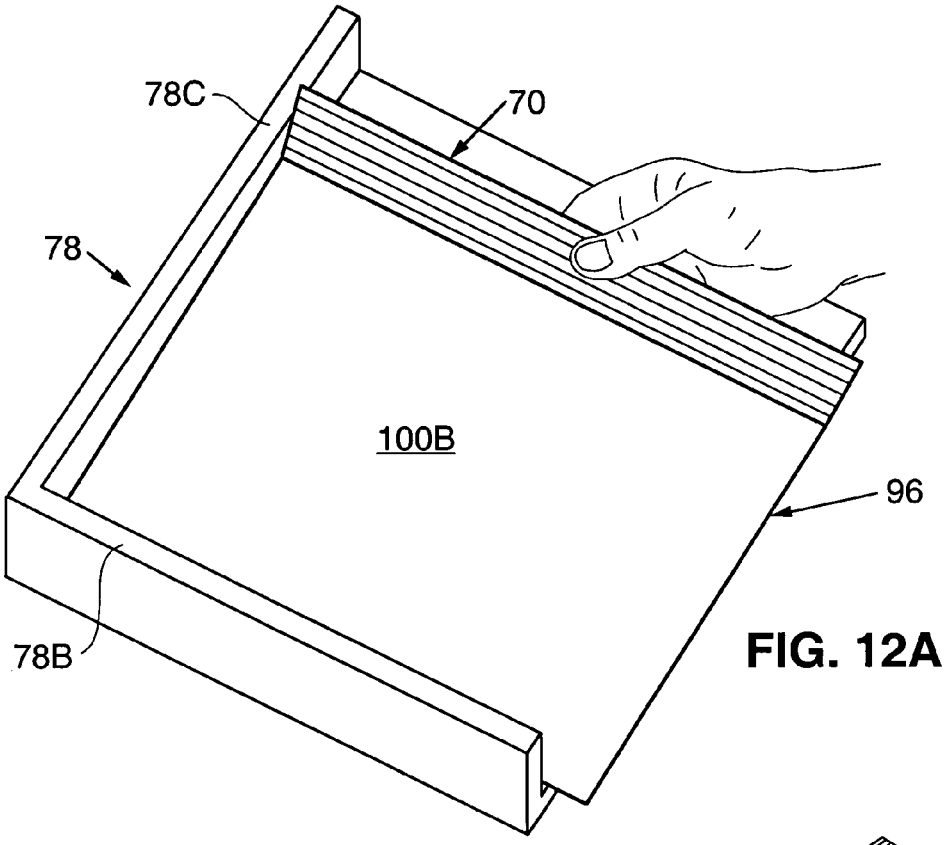
FIGS. 12A-12H depict a sequence for binding a stack of sheets in accordance with the second embodiment of the present invention.
Figure 12B:
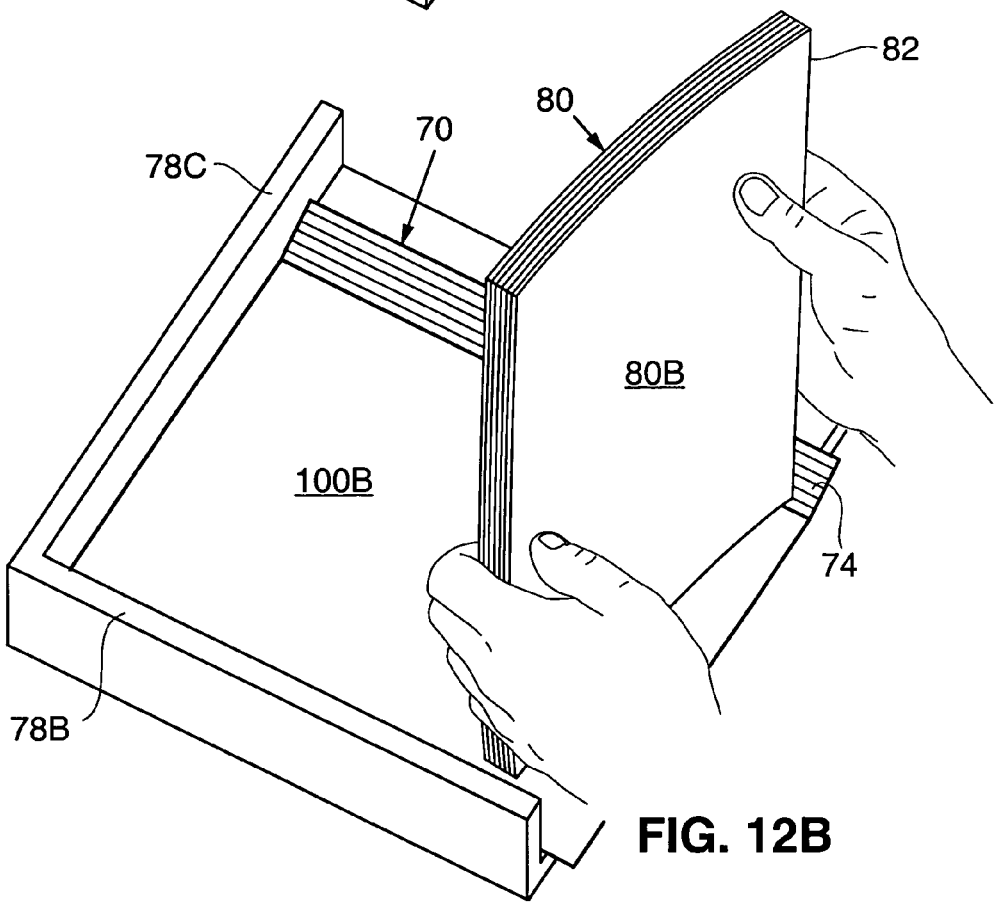
Figure 12C:
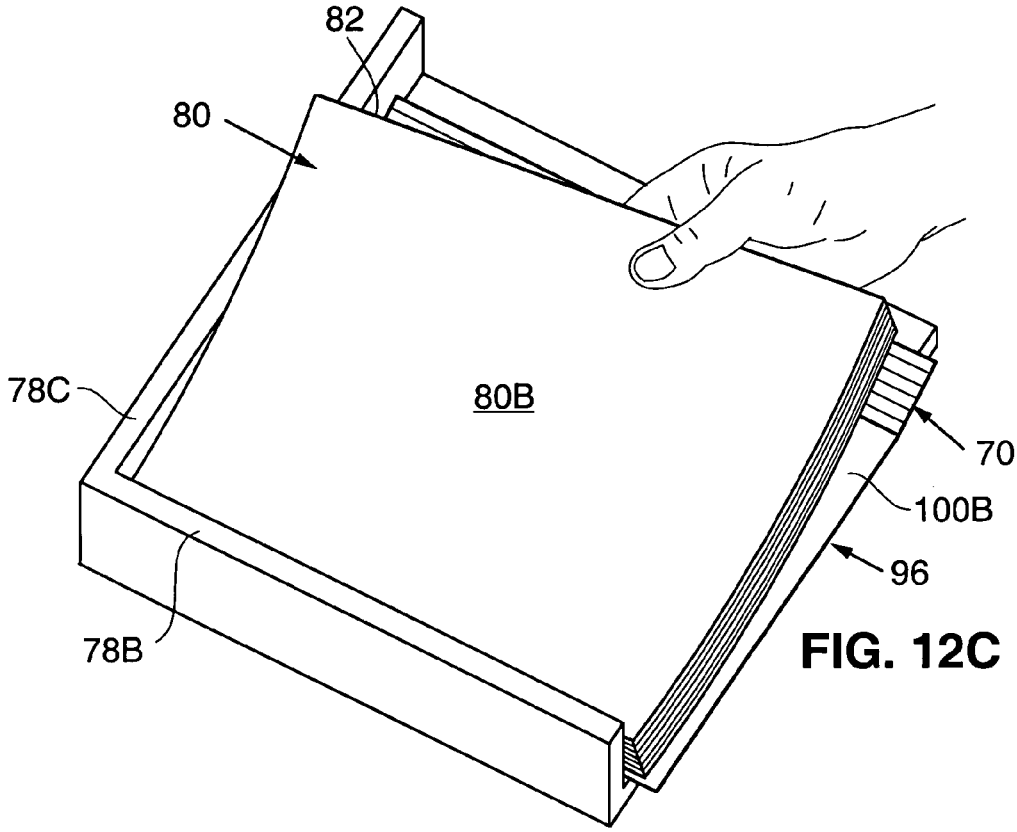

The initial steps in forming a hardcover book using the second embodiment apparatus are similar to those of the first embodiment. As shown in FIG. 12A, the front cover element 96 is positioned on the guide apparatus 78 with the spine element 70 on the user's right and with inner sheet 100B exposed. The respective orthogonal edges of the cover element 96 are positioned abutting wall members 78B and 78C. A stack 80 to be bound is positioned over front cover element 96 as shown in FIGS. 12B and 12C, with the edge 82 to be bound adjacent the spine element 70. The respective edges of stack 80 are positioned to abut wall members 78B and 78C.

Figure 12D:
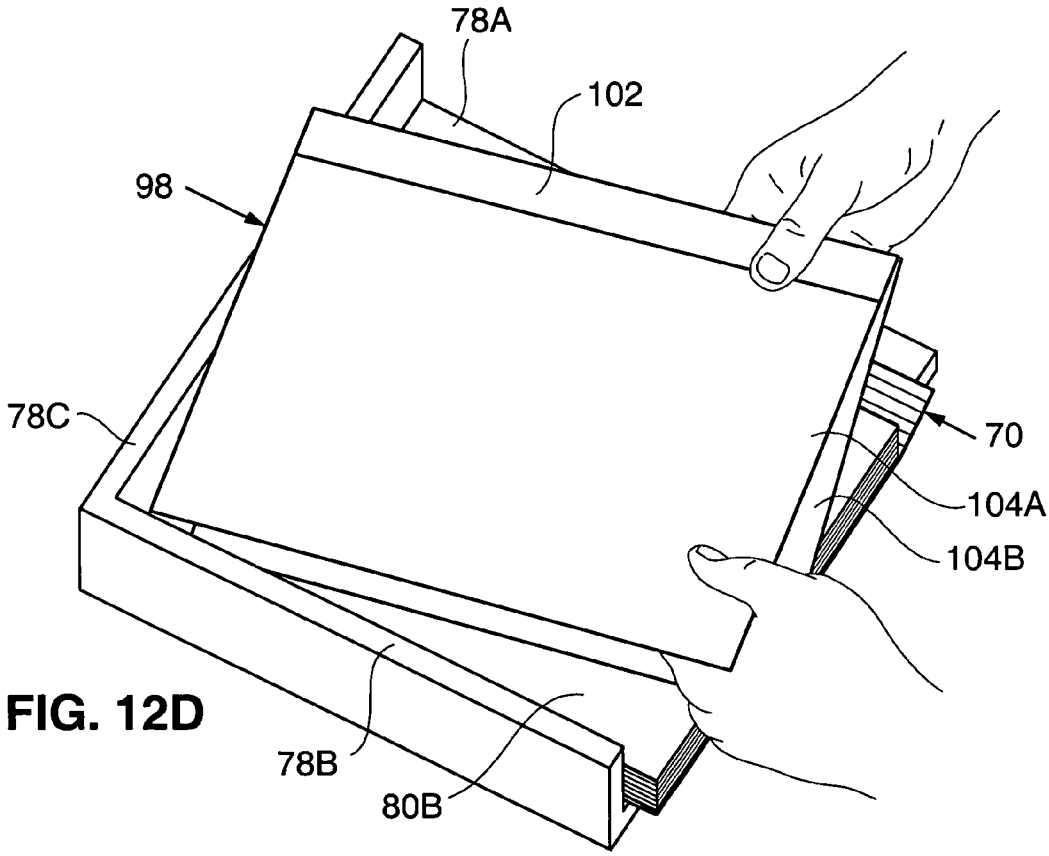
Figure 12E:
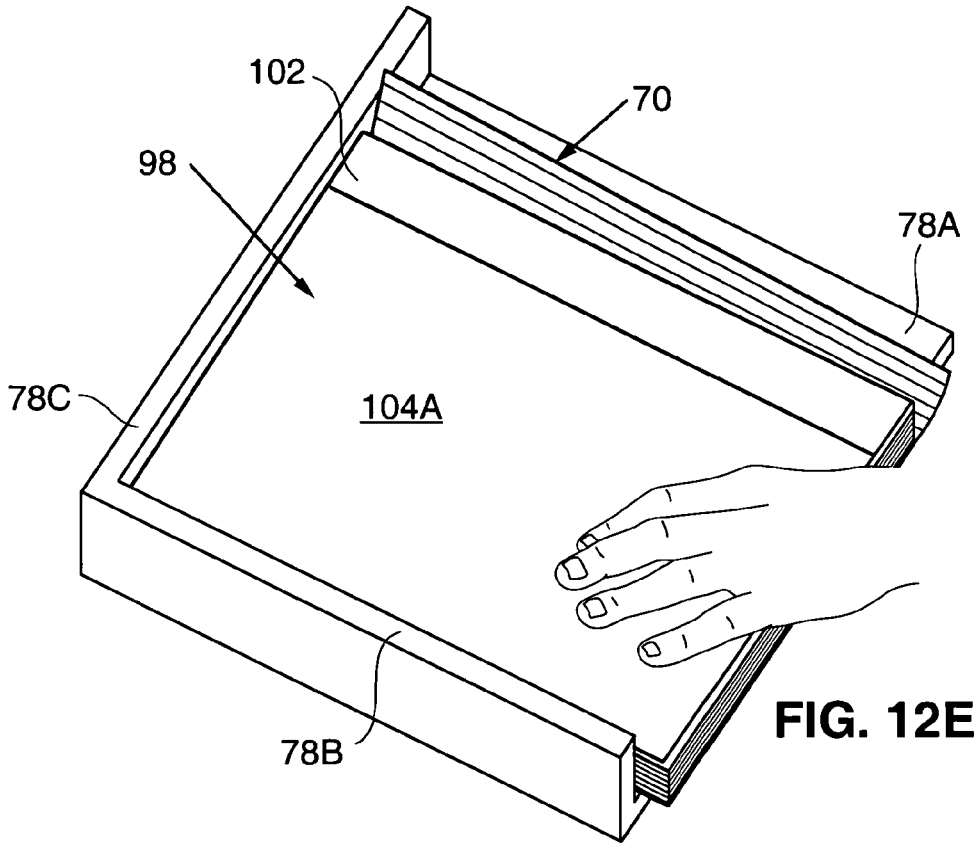
Figure 12F:
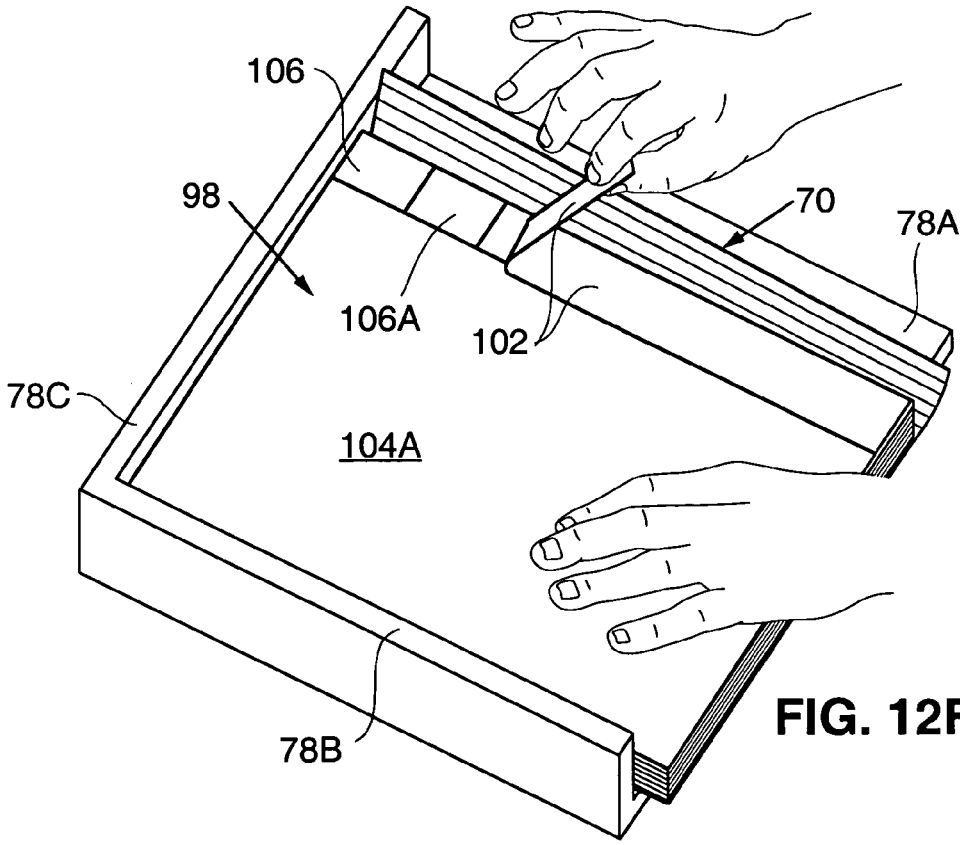
Figure 12G:
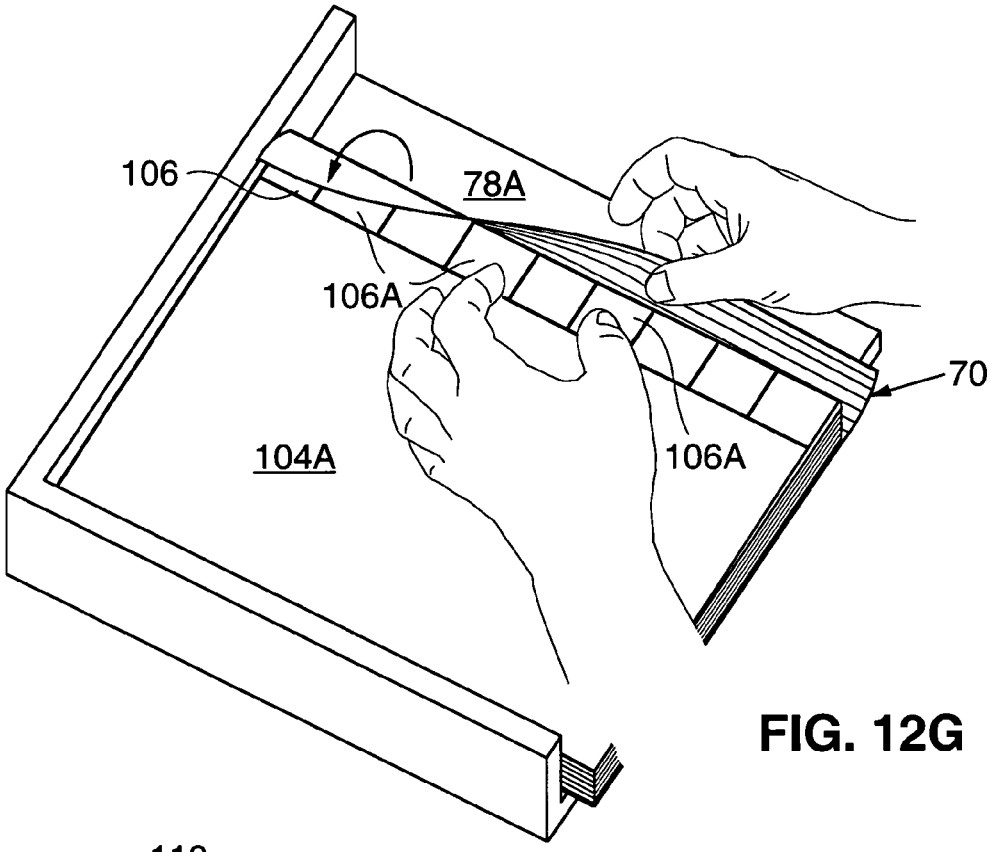

Once the stack 80 is in position, back cover element 98 is positioned over the stack, as shown in FIGS. 12D and 12E, with the release liner 102 on the user's right. The orthogonal edges of the back cover element 98 are positioned abutting the respective wall members 78B and 78C. Next, release liner 102 is removed as shown in FIG. 12F, thereby exposing the underlying pressure sensitive adhesive 106. As shown in FIG. 12G, the user then wraps the free edge of the spine element 70 tightly around the edge of the stack with one hand, while holding the stack down with the other hand. Again, gaps 106A are periodically formed in pressure sensitive adhesive 106 so that the user can hold the stack in place without contacting the adhesive. The adhesive 106 function to secure the free edge of the spine element 70 to the outer sheet 104A. Thus, the front and rear cover elements 96 and 98 are secured together.

Figure 12H:
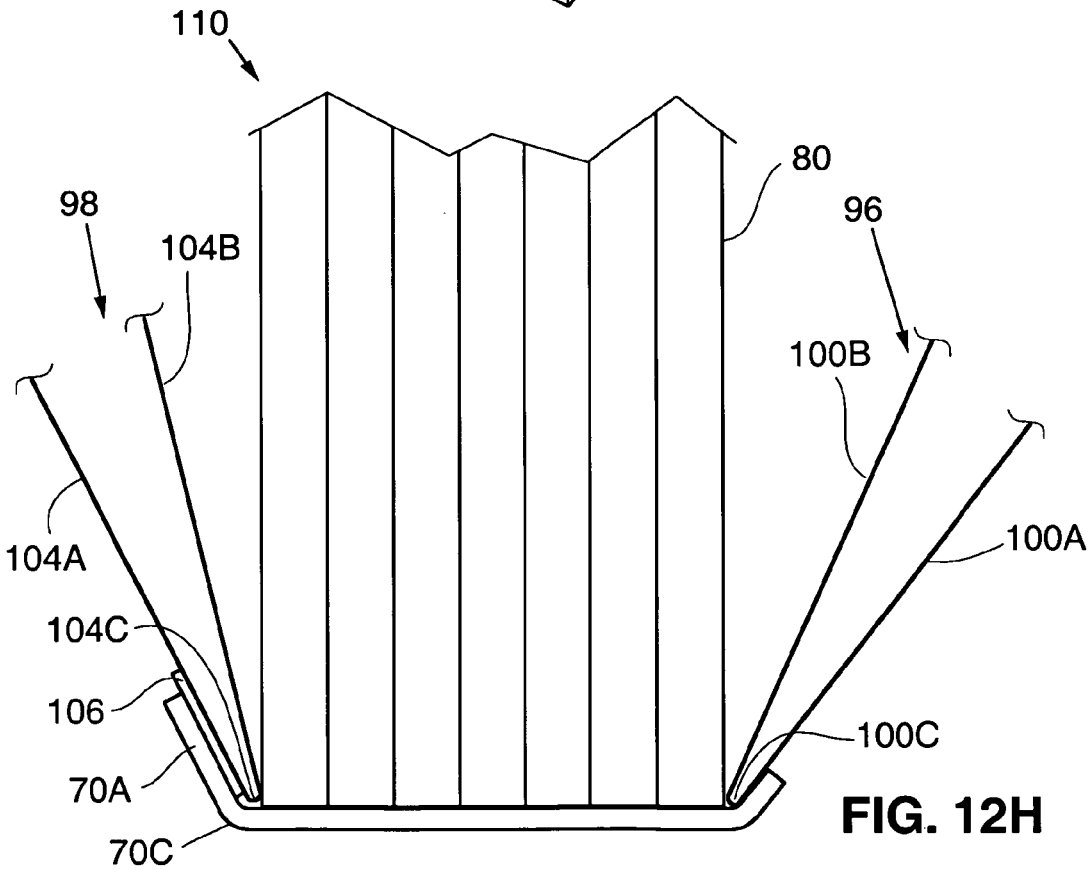

FIG. 12H is a schematic representation of the resultant structure, with the front and rear cover elements 96 and 98 folded slightly outward from the stack 80 for purposes of illustration. The spine element 70 has a bend 70C, the location of which is a function of the thickness of the stack 80, as is the length of the spine element extension 70A secured to the outer sheet 104A by adhesive 106. Note that there will typically be some amount of exposed pressure sensitive adhesive 106. In the first embodiment, this adhesive is covered by flap member 60A (FIG. 8J). As will become apparent, the exposed adhesive 106 in the second embodiment will become covered by the hardcover to be subsequently applied. The structure is then carefully lifted from the guide apparatus 78 and placed in the heating unit 88 as shown in FIG. 8K so as to activate adhesive 74 (FIG. 6) of the spine element 70. Once the structure has been heated for the requisite time, it is removed and placed on a cooling rack.

Figure 13:
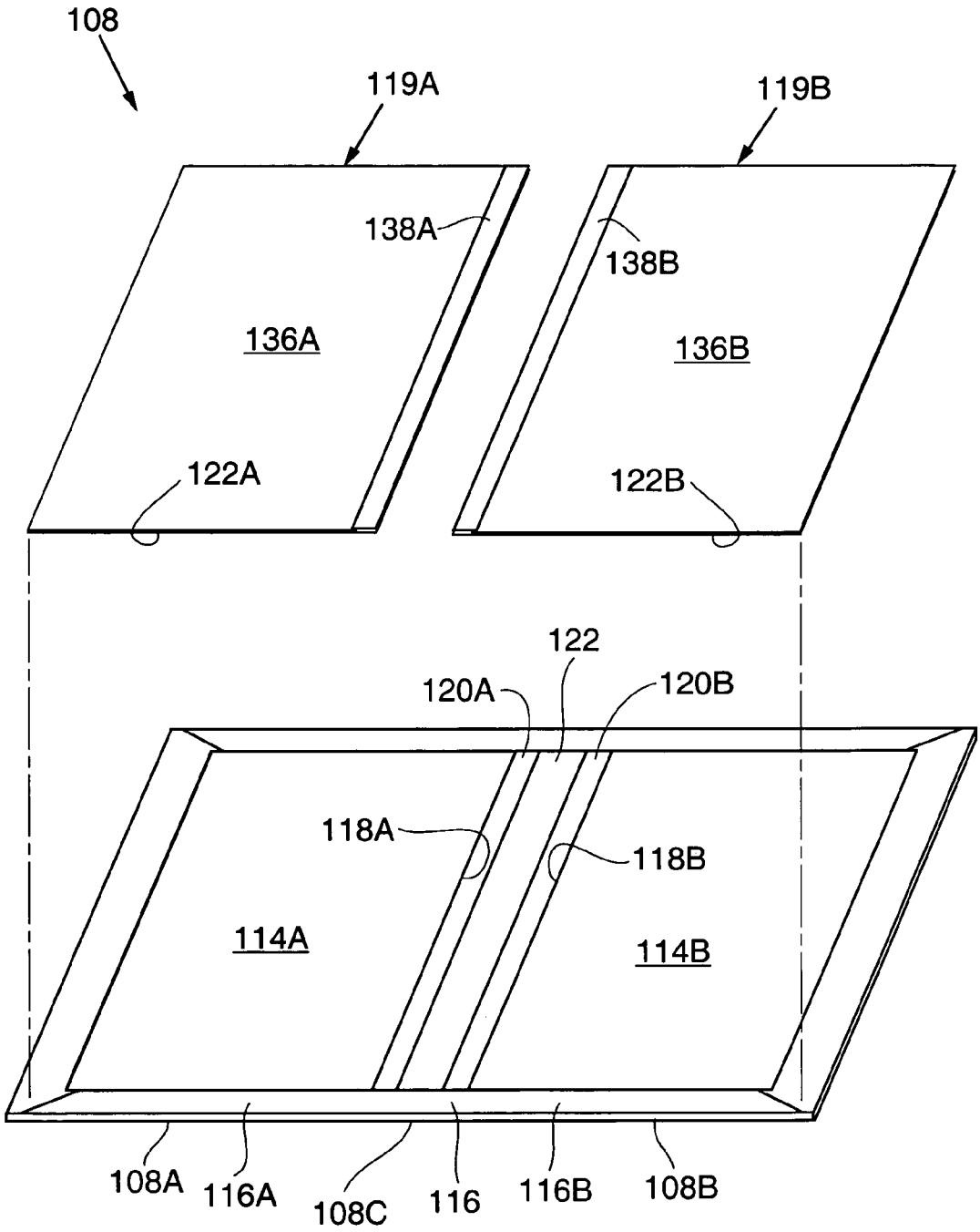
FIG. 13 is an exploded perspective view of a hardcover assembly for covering a bound stack of sheets.

The application of the hardcover assembly to bound stack 110 will now be described. FIG. 13 shows details of the hardcover assembly 108 that is applied to the bound stack 110. Preferably, the cover assembly 108 is completely assembled and sold separately to the user. As will be described, the cover assembly 108 will be manufactured in various sizes to accommodate differing size stacks 110 in terms of stack thickness. It is further anticipated that a user can request that certain information be preprinted on the assembly 108, including title information and any other graphics. As will be described, hardcover assembly 108 includes the front and back cover sections halves 108A and 108B, respectively, separated by a spine section 108C.

The cover assembly 108 includes a pair of relatively stiff cover boards 114A and 114B made of cardboard or the like. The cover boards 114A and 114B are typically 8⅜ inches by 11 5/16 inches for binding 8½ by 11 inch stack 110. The cover boards are covered with a flexible cover membrane 116, typically fabric, which is folded around the edges of the cover boards, as depicted in FIG. 13. That part of the cover membrane 116 disposed intermediate the opposite edges 118A and 118B of the cover boards is unsupported and is thus relatively flexible. A length of fabric or stiff paper (not depicted in FIG. 13), typically 0.010 inches thick, is preferably disposed in the spine section 108C of the hardcover assembly 108 so as to slightly stiffen the membrane 116 in that location so that a desired shape is achieved when the bound book is opened and closed. The membrane regions 120A and 120B disposed between the respective edges of the spine section 122 and the respective edges 118A and 118B of the cover boards 114A and 114B are referred to as gutter regions. The gutter regions 120A and 120B are each fixed in width at ⅜ of an inch. The gutter regions define the flexible portion of the cover membrane. Alternatively, a spine board (not depicted), made of the same material as the cover boards 114A and 114B and having a shape that generally corresponds to the spine region 122, can be used. The spine board, which is typically 0.088 inches thick, functions to stiffen the spine 122, with spine flexibility being provided by the flexible gutter regions 120A and 120B disposed between the respective edges of the cover boards 114A and 114B and the respective edges of the spine board. When the spine board is used, the gutter region 120A and 120B widths are preferably increased slightly to 7/16 of an inch.

The spine region 122 width varies, along with the width of the spine board if one is used, depending upon the width of the stack 110 to be bound. The cover assemblies are preferably prefabricated in various widths to accommodate stacks 110 of various widths as set forth below in Table 1.

TABLE 1

| Model | Spine 122 Width (inches) | Stack 110 Thickness (inches) |
|---|---|---|
| A | ⅜ | To ¼ |
| B | ½ | ¼ to ½ |
| C | ¾ | ½ to ¾ |
| D | 1 | ¾ to 1 |
| E | 1¼ | 1 to 1¼ |
| F | 1½ | 1¼ to 1½ |

The number of available spine widths can be increased or decreased from the values set forth above in Table 1, with a larger number increasing the difficulty of maintaining an adequate inventory and a smaller number detracting somewhat from the appearance of the final product in the spine region.

Figure 14:
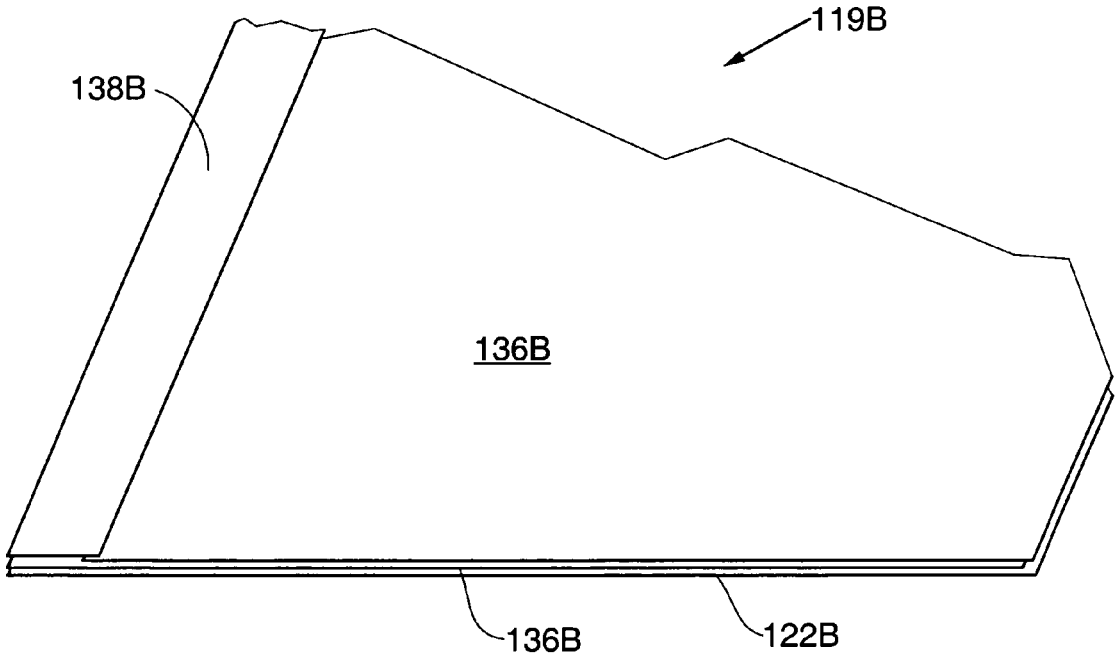
FIG. 14 is a perspective view of one of the two pressure sensitive adhesive sheet structures used with the hardcover assembly of FIG. 13.
Figure 15:
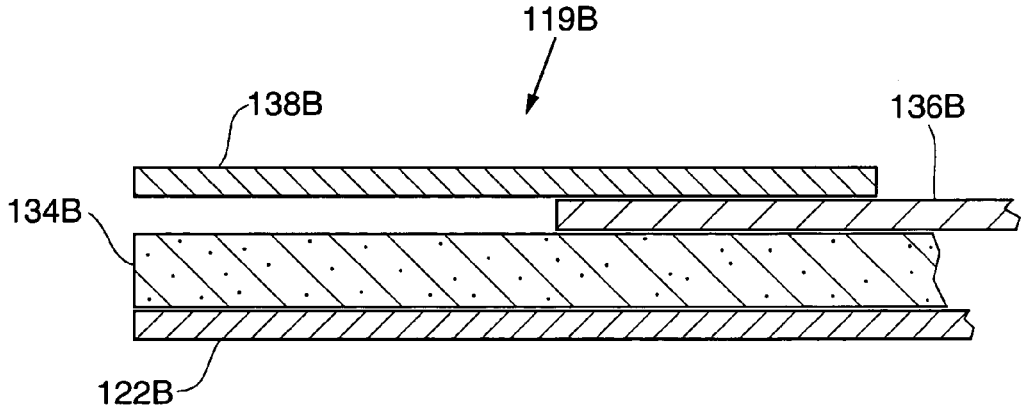
FIG. 15 is a cross-section elevational view of a portion of the adhesive sheet structure of FIG. 14.

Referring back to FIG. 13, the cover assembly 108 is prefabricated using a pair of pressure sensitive adhesive sheets structure 119A and 119B. Further details of the adhesive sheets are also shown in FIGS. 14 and 15. Adhesive sheet structures 119A and 119B are dimensioned 8¼ by 10¾ inches when the stack 110 size is 8½ by 11 inches, to cover the interior periphery of the folded portions of the cover membrane 116A and 116B and to further secure the periphery of the membrane to the respective cover boards 114A and 114B. The smaller size of the underlying sheets 122A and 122B of the sheet structure ensures that the folded liner sheets 104A and 100A completely cover sheets 122A and 122B despite any small misalignment. Each sheet structure includes an upper major release liner 136A and 136B disposed over the underlying or bottom sheets 122A and 122B. A layer of pressure sensitive adhesive 134A and 134B is disposed intermediate that upper release liners and the bottom sheet. A pressure sensitive adhesive manufactured by National Starch and Chemical Company and marketed under the designation Instant-Lok, type HL PSA 20-81, has been found suitable for this application. The adhesive layers 134A and 134B are preferably 0.003 to 0.004 inches in thickness.

The upper major release liners 136A and 136B are disposed over a majority of the underlying pressure sensitive adhesive layers. Generally, at least 75% of the adhesive layers are covered by the respective upper major release liners 136A and 136B, with a remaining strip of the adhesive along the inner edge of the sheet structures not being covered by the major release liners 136A and 136B. Instead, upper minor release liners 138A and 138B are disposed over the remainder of the adhesive layers. This relationship is shown schematically in FIG. 15 (not to scale) where a portion of the sheet structure 119B is depicted. As can be seen, the pressure sensitive adhesive layer 134B is disposed between the bottom sheet 122B and upper major and minor release liners 136B and 138B. That portion of the adhesive layer 136B not covered by the upper major release liner 136B is covered by a separate upper minor release liner 138B. The minor release liner 138B is shown separated from adhesive layer 136B in the schematic diagram of FIG. 15, but is actually positioned contacting the adhesive layer and is secured in place by the adhesive layer. All of the release liners 136A, 138A, 136B and 138B are fabricated from the same material used, for example, for release liners 64 and 66 (FIG. 2). Such materials only slightly adhere to the pressure sensitive adhesive so that the release liners can be manually separated from the adhesive without damage to the adhesive or the release liners. As part of the prefabrication of the hardcover assembly 108, conventional case glue is applied to the top of the cover sections 108A and 108B and to the bottom sheets 122A and 122B. The sheet structures are then positioned over the respective cover sections 108A and 108B as shown in FIG. 13 so that the sheet structures will be secured to the cover sections by the case glue. Thus, the sheet structures 119A and 119B are secured to the cover boards 114A and 114B and to the peripheral portions of the cover membrane 116 by way of the case glue. This completes the prefabrication of the hardcover assembly 108.

Figure 16:
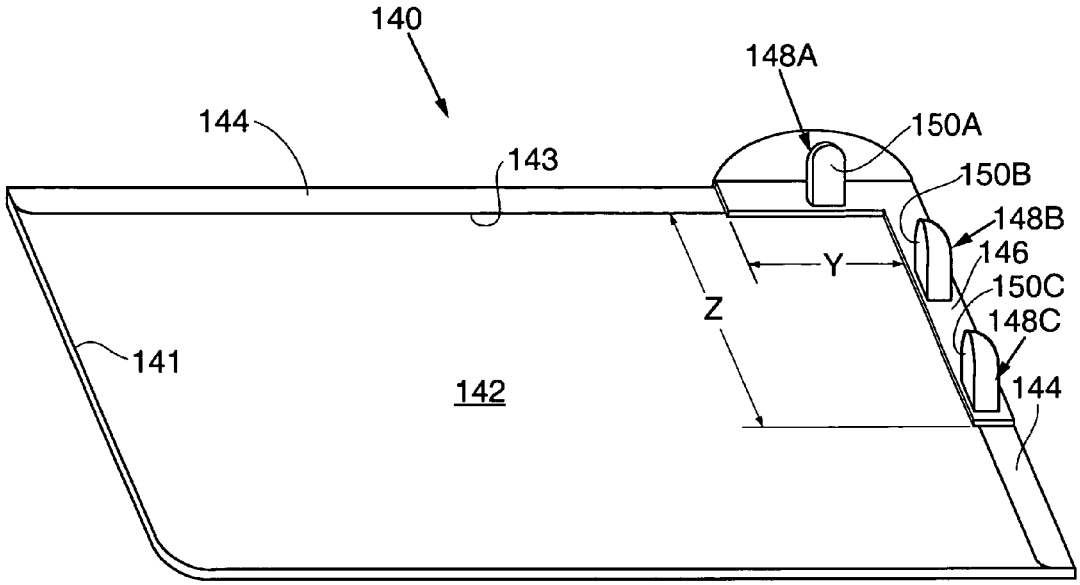
FIG. 16 is a perspective view of the guide apparatus used to attach the hardcover assembly to the bound stack.
Figure 17:
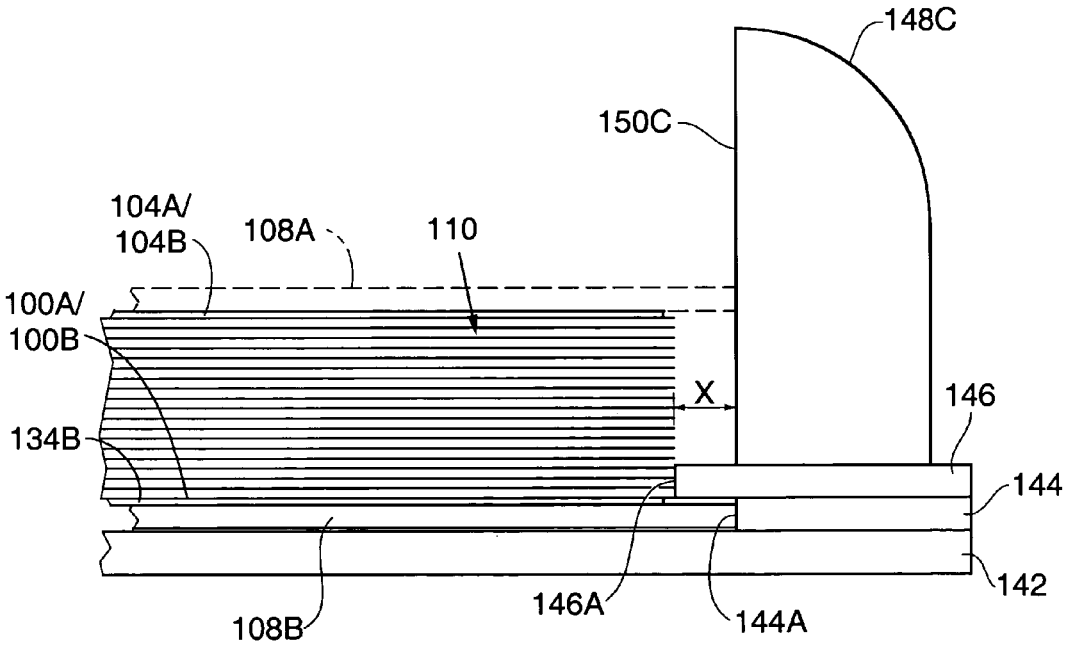
FIG. 17 is an expanded side view of a portion of the guide apparatus of FIG. 16 with a stack to be bound shown in position.

Referring now to FIGS. 16 and 17, a second type of guide apparatus 140 is disclosed for use in carrying out the process for adding the hardcover to the bound stack 110. Guide apparatus 140 includes a flat base member having a receiving surface 142 that is somewhat larger that the largest book to be bound when the book is in the open position. A stop member 144, having two orthogonal segments, is supported on the upper surfaced 142 of the base member and extends around two adjacent sides of the base member. A ledge member 146, also having two orthogonal segments, is supported above the stop member 144 and, as can be in FIG. 17, have outer edges 146A which extend past the edge 144A of the stop member a small distance X, with the overhang being typically 0.16 inches. The height of ledge member 146 above the support surface 142 is great enough to accommodate the thickness of the cover sections 108A and 108B of the cover assembly 108. The ledge member 146 extends along stop member 144 in one direction a distance Y (FIG. 16) that is somewhat smaller than the closed width of the smallest book to be bound. The distance Z, the distance that the ledge member 146 extends along stop member 144 in the other direction, is typically about twice dimension Y.

The guide apparatus 140 also preferably includes two or more vertical stop members, such as 148A, 148B and 148C, with vertical stop member 148A being supported on ledge member 146 about one third of the distance Y of the ledge member from the corner formed by the intersection of the two ledge member 146 segments. Vertical stop member 148B and 148C are at approximate equal distances along the other ledge member 146 segment. As can best be seen in FIG. 17, the vertical stop members each have a planar surface, surface 150C for example, that coincides with the inner edge, such as edge 144A for example, of the stop member. This configuration also applies to the respective planar surfaces 150A and 150B of vertical stop members 148A and 148B. The orthogonal wall members 78B and 78C of the first guide apparatus 78 (FIG. 8A) could be added to guide apparatus 140, with member 78B being positioned along the edge 141 of surface 142 opposite stop members 148B and 148C and with member 78C on the same edge 143 of surface 142 as stop 148A. In that case, only a single guide apparatus need be used.

Figure 18A:
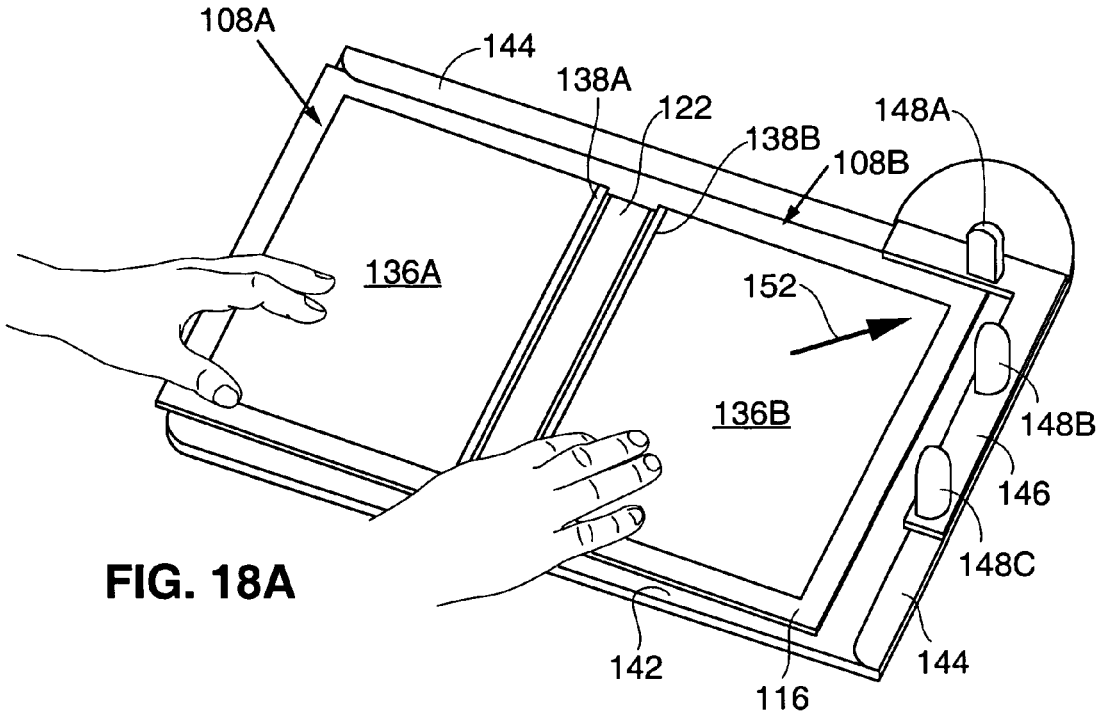
FIGS. 18A-18M depict the process for applying the hardcover assembly to the bound stack.

The sequence for adding the hardcover assembly 108 will now be described, starting with reference to FIG. 18A. The opened hardcover assembly 108 is first positioned on the guide apparatus receiving surface 142, with the upper release liners 136A and 136B facing upwards. As indicated by arrow 152, the hardcover assembly is moved along the surface 142 of the guide apparatus until the respective orthogonal edges of cover section 108B are positioned under the ledge member 146, abutting the inner edge 144A of the stop member 144A, as shown in FIG. 17. Thus, the outer edge 146A of the ledge member 146 will be positioned a fixed distance X from the edge of cover 108B along the full length of both orthogonal segments of the ledge member 146 as shown in FIG. 17. The outer edge 146A will provide a guide for positioning the bound stack 110, as will be described. A modified version of guide apparatus 140 is disclosed in co-pending U.S. patent application Ser. No. 10/385,960 filed on Mar. 10, 2003 and entitled "Guide Apparatus of Use in Making a Hardcover Book", the contents of which are fully incorporated herein by reference. Among other things, the guide apparatus disclosed in application Ser. No. 10/385,960 discloses structure for providing support for the edge of stack 110 along the full height of the stack, whereas outer edge 146A of apparatus 140 provides support only at the lower portion of the stack.

Figure 18B:
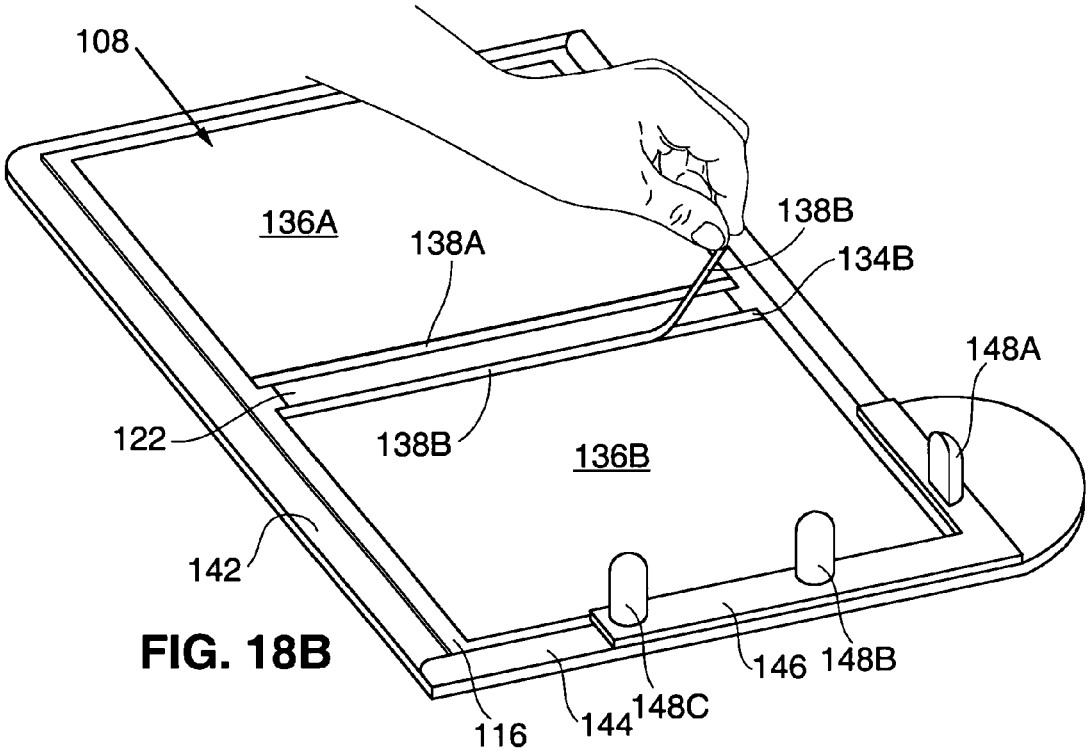
Figure 18C:
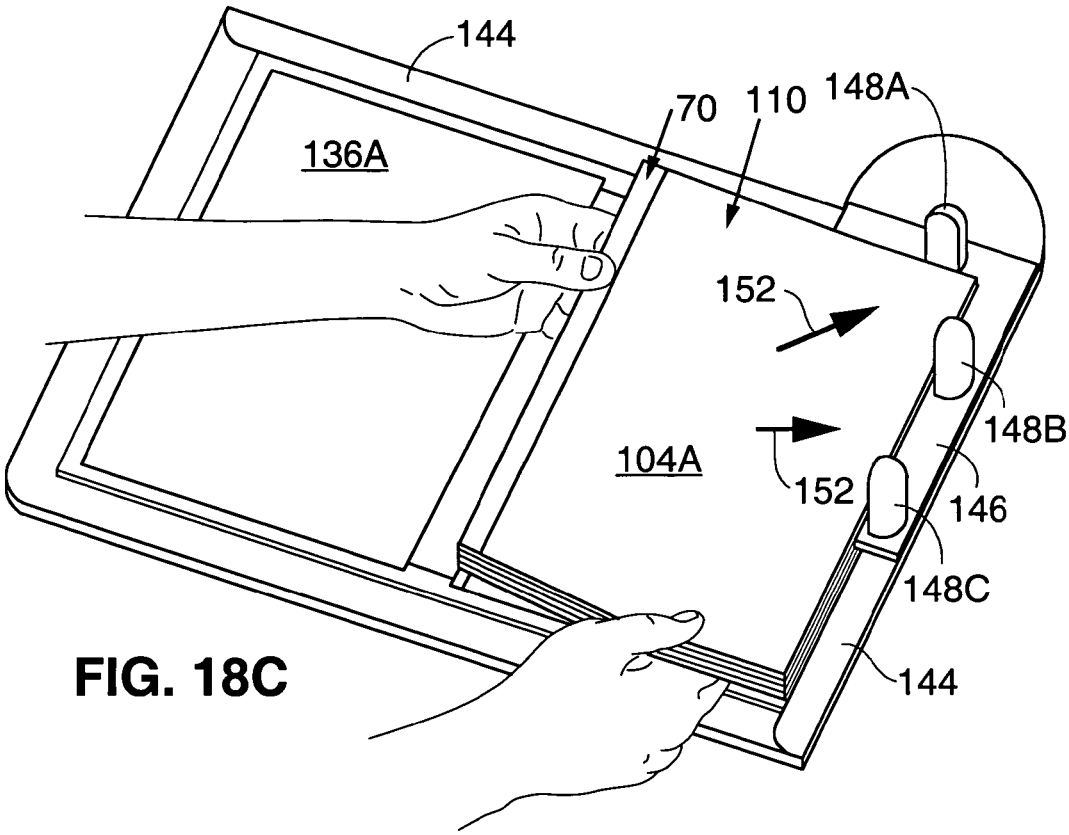
Figure 18D:
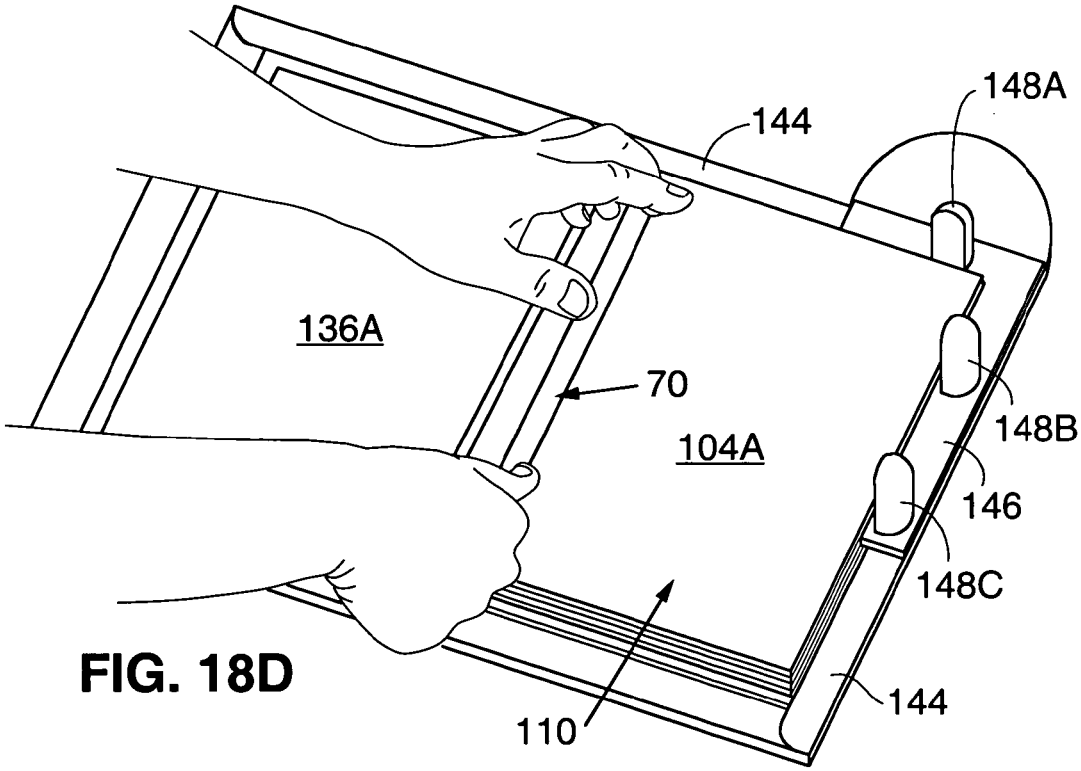

Once the hardcover assembly 108 is properly positioned on the guide apparatus 140, the user manually separates the upper minor release liner 138B, as shown in FIG. 18B, from the assembly 108. This will expose a relatively narrow strip of the underlying pressure sensitive adhesive 134B adjacent spine region 122. Next, the bound stack 110 is placed over the upper major release liner 136B, with the edges of the stack engaging edge 146A of the ledge member 146 along both orthogonal segments. FIG. 17 shows the edge of stack 110 engaging edge 146A along one of the two segments. As shown in FIG. 18C by arrows 152, that portion of stack 110 above the exposed adhesive 134B is not placed on the exposed adhesive until the orthogonal edges of the stack are positioned against edge 146A of both segments. Once the correct position of stack 110 is achieved, the stack is pressed down upon the exposed pressure sensitive adhesive 134B as shown in FIG. 18D. This operates to secure the inner edge of folded liner sheet 100A along fold 100C (FIG. 12H) to cover section 108B in a correctly aligned position.

Figure 18E:
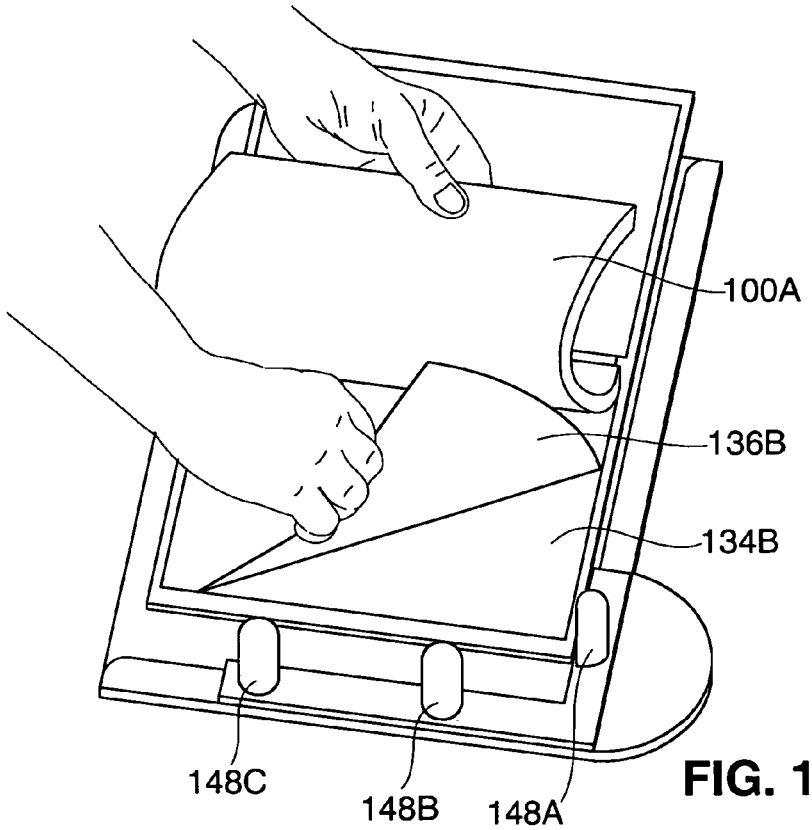
Figure 18F:
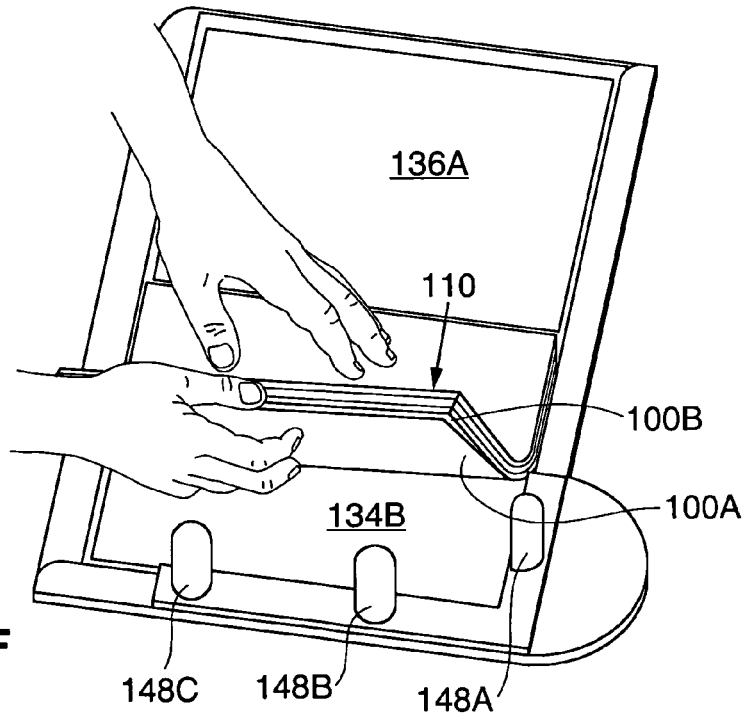
Figure 18G:
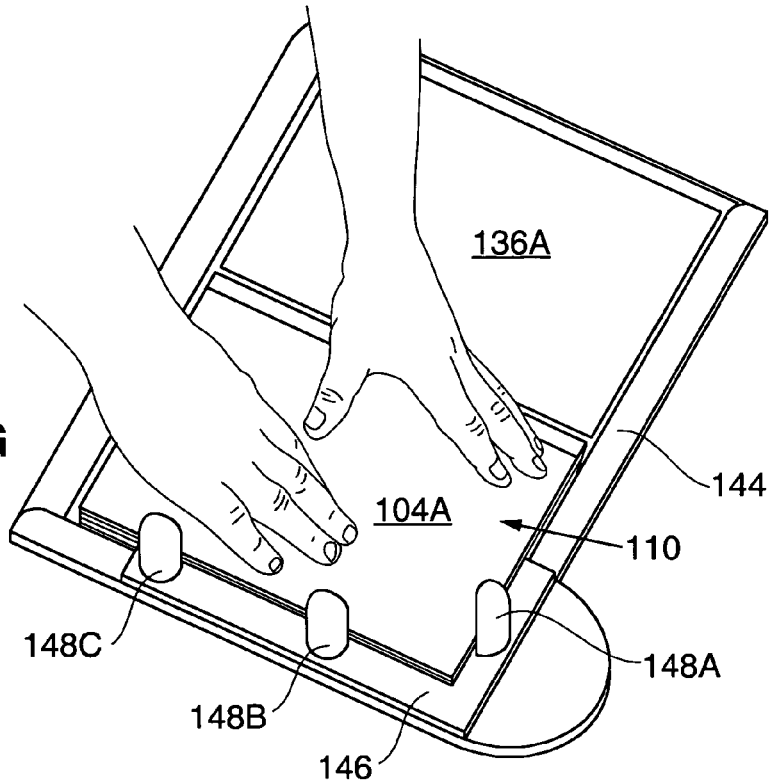

The next step is to secure the remainder of the folded liner sheet 100A of stack 110 to the adhesive 134B of assembly 108. Referring to FIG. 18E, the free edge of stack 110, including liner sheet 100A, is lifted up and rotated away from the upper major release liner 136B. This permits the major release liner 136B to be separated from the hardcover assembly 108 thereby exposing the remainder of the pressure sensitive adhesive 134B. As shown in FIG. 18F, the spine portion of stack 110 is held down against the hardcover assembly 108 with one hand while stack 110 is rotated down over the adhesive 136B with the other hand. As shown in FIG. 18G, the user then presses all of stack 110 down on the hardcover assembly 108. This causes the remainder of the liner sheet 100A of the stack to be secured by the remainder of adhesive 134B to cover section 108B of the hardcover assembly 108. The second cover section 108A of the hardcover assembly will now be attached.

Figure 18H:
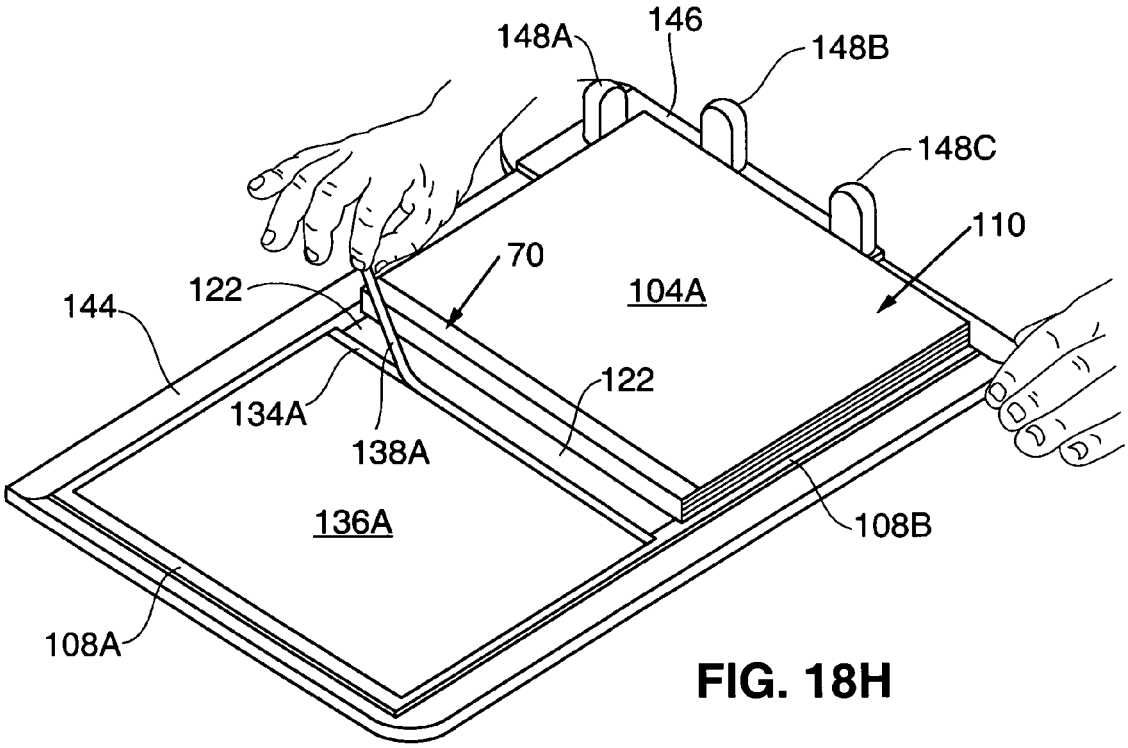
Figure 18I:
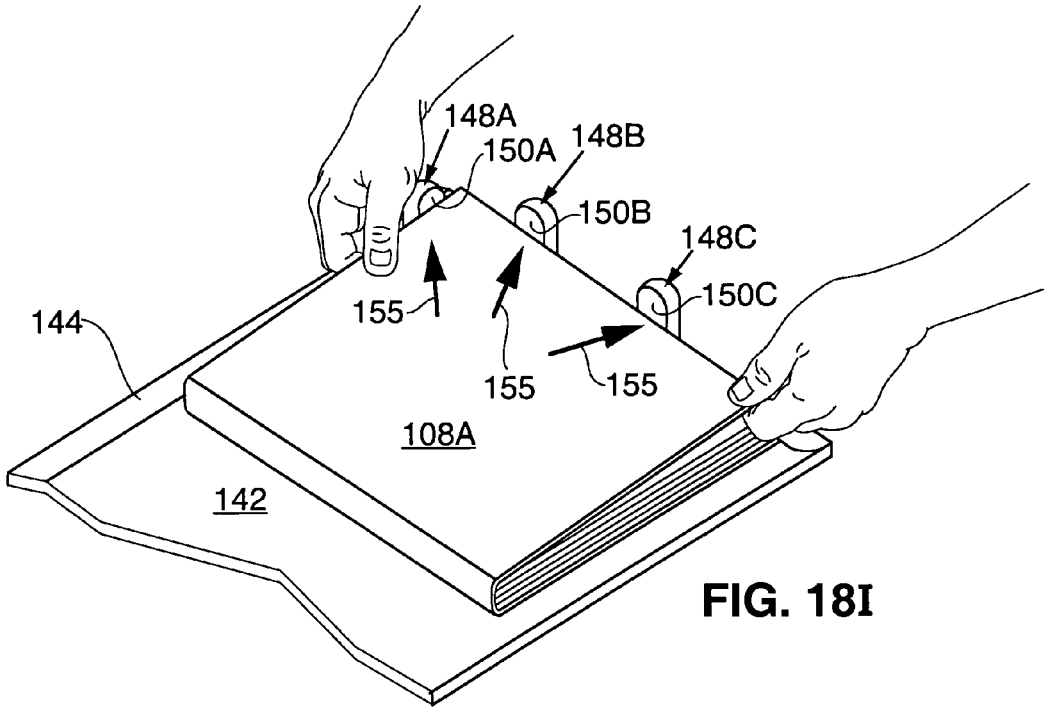
Figure 18J:
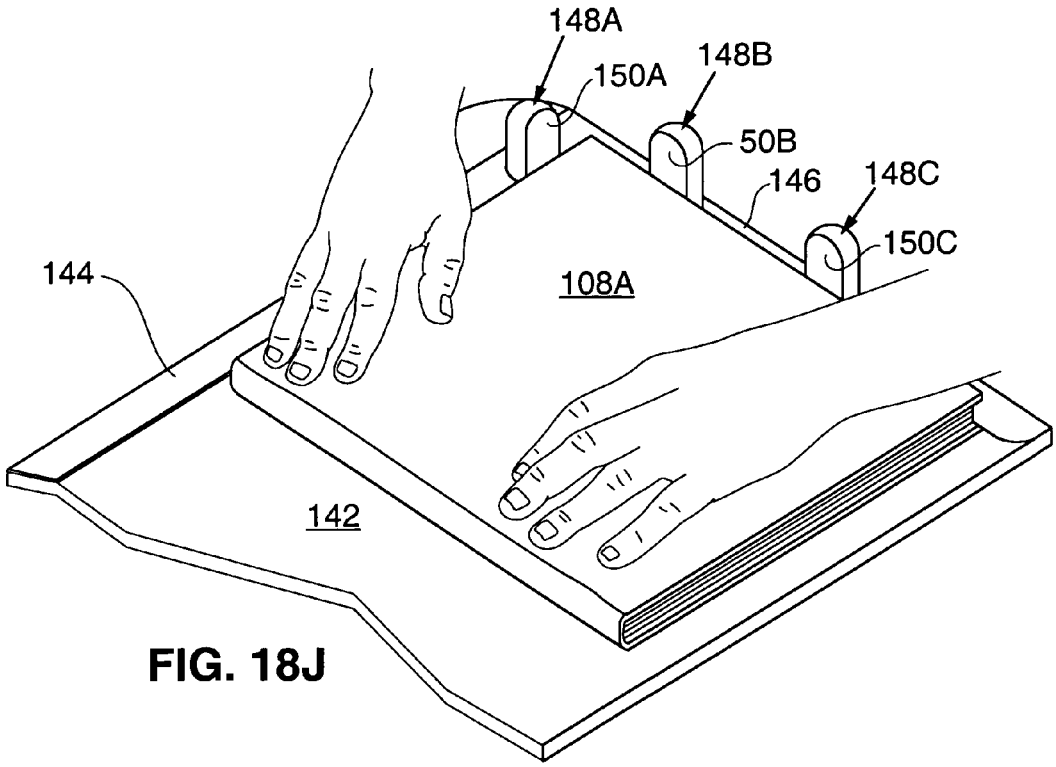

Referring to FIG. 18H, the upper minor release liner 138A is next separated from the front cover section 108A of the hardcover assembly thereby exposing a strip of pressure sensitive adhesive 134A adjacent spine region 122. The user then lifts the cover section 108A of the hardcover assembly away from the surface 142 of the guide apparatus and rotates the cover section 108A around the spine. As indicated by arrows 154 of FIG. 18I, the cover section 108A is positioned so that the respective edges of the cover section 108A contact the planar surfaces 150A, 150B and 150C of the respective three vertical stop members 148A, 148B and 148C. This is shown in phantom in FIG. 17. The hardcover assembly 108 is then positioned correctly with respect to the bound stack 110. The user then presses the cover section 108A down as shown in FIG. 18J, in the regions adjacent the spine, so that the edge of folded liner sheet 104A of stack 110 near fold line 104C is secured to the hardcover assembly 108 by way of the exposed strip of adhesive 134A.

Figure 18K:
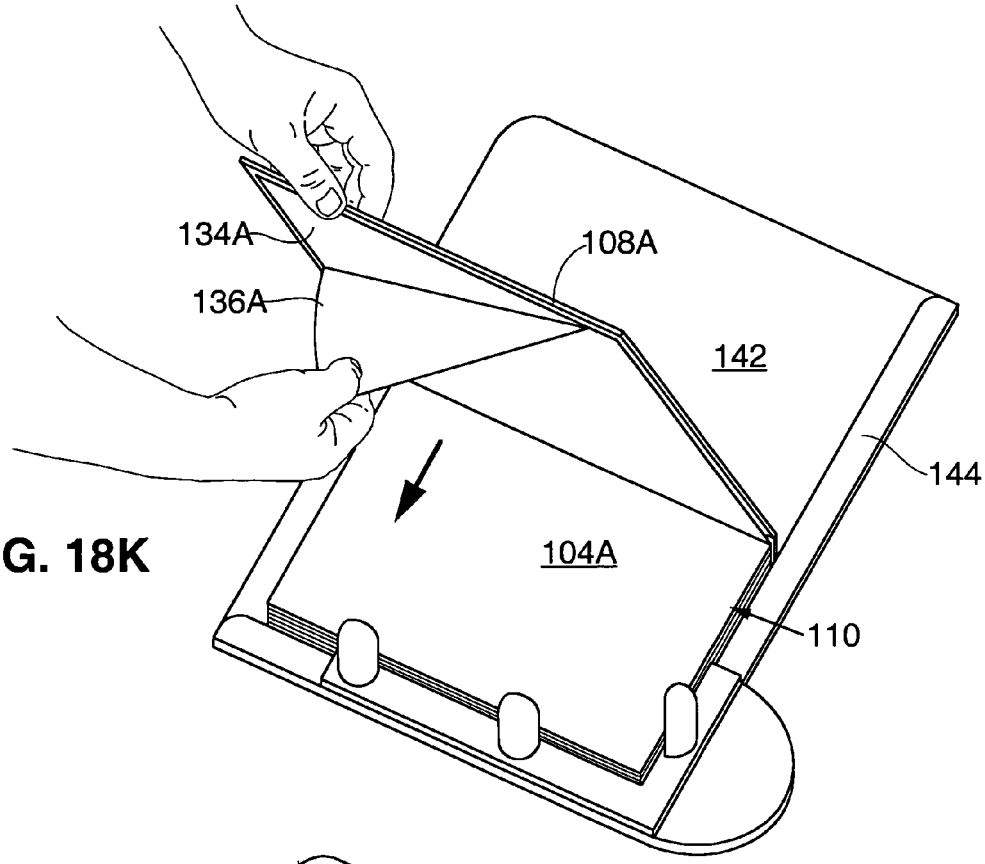
Figure 18L:
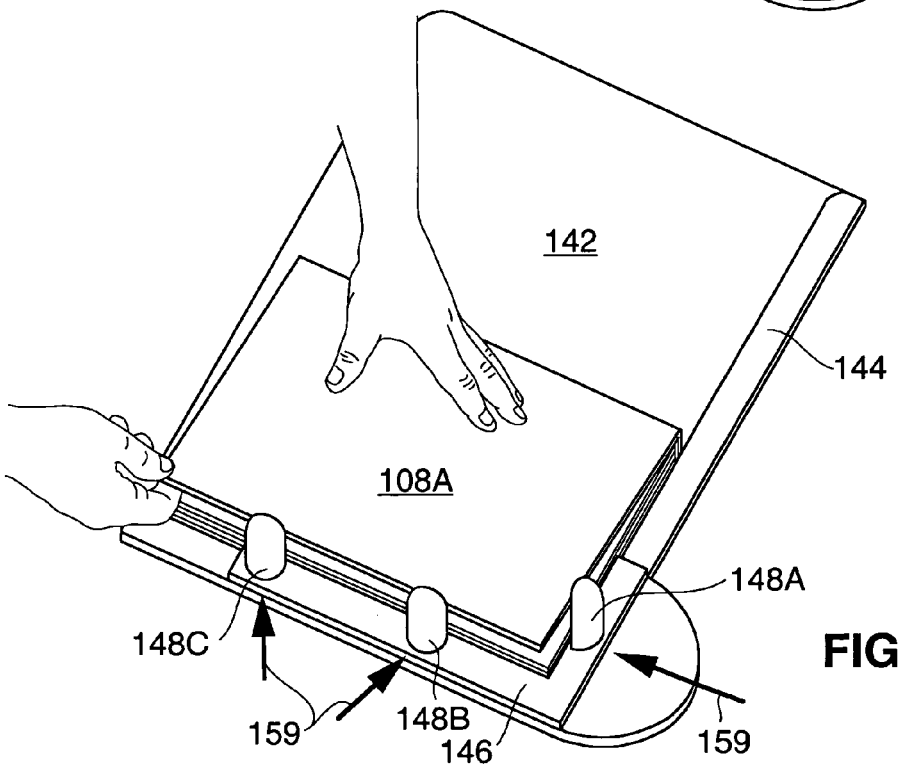
Figure 18M:
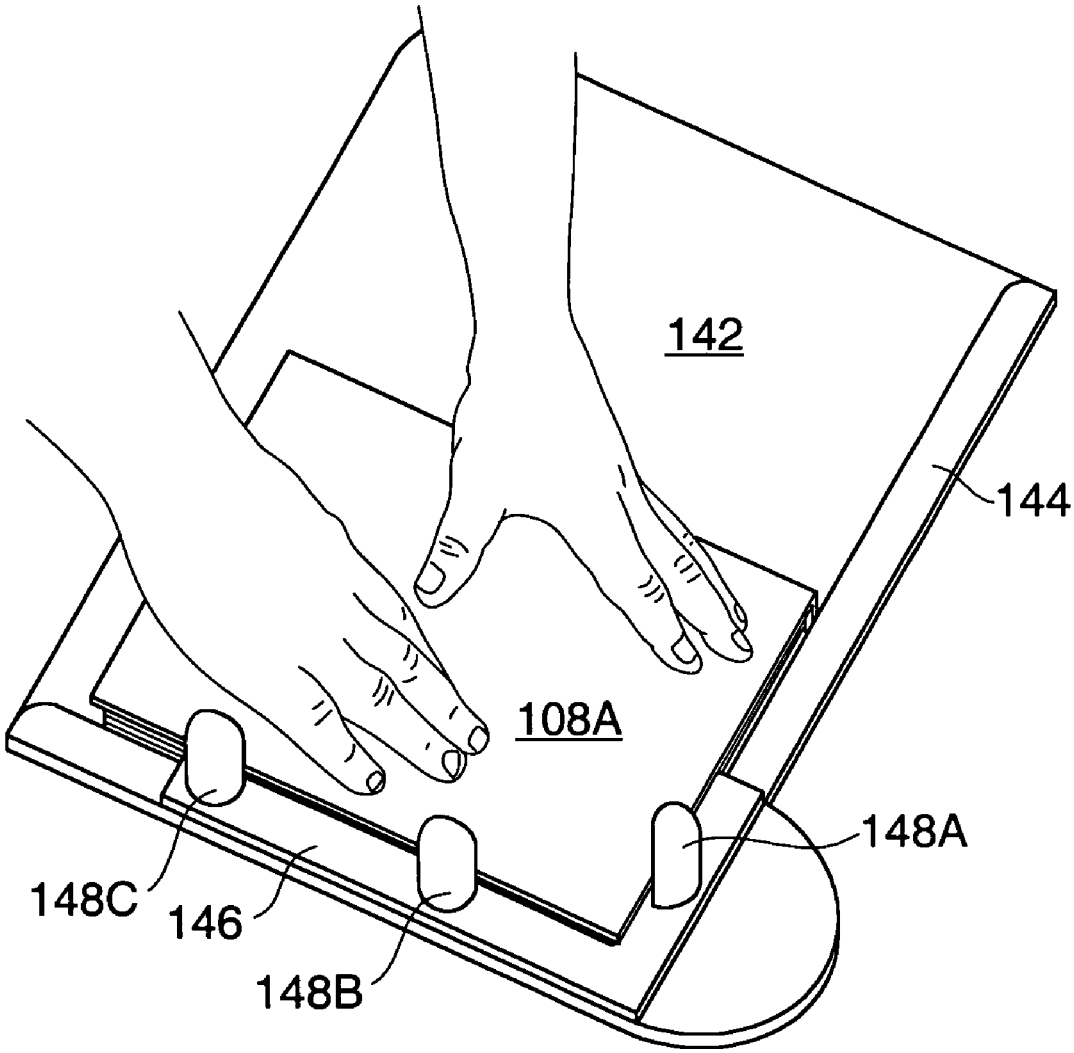

As shown in FIG. 18K, the user then lifts cover section 108A up and rotates the cover section away from stack 110, with a narrow strip of liner sheet 104A of the stack remaining secured to cover section 108A. This permits upper major release liner 136A to be separated from hardcover assembly 108 thereby exposing the remainder of pressure sensitive adhesive layer 134A. Cover 108A is then placed rotated back down onto stack 110, where the edges of the cover should again be in contact with the respective surfaces of stops 148A, 148 and 148C, as shown in FIG. 18L by arrows 159. The user then presses down on cover section 108A as shown in FIG. 18M thereby securing the cover section 108A to the remainder of folded liner sheet 104A of stack 110. This completes the binding sequence, including the application of the hardcover assembly 108.

Figure 19A:
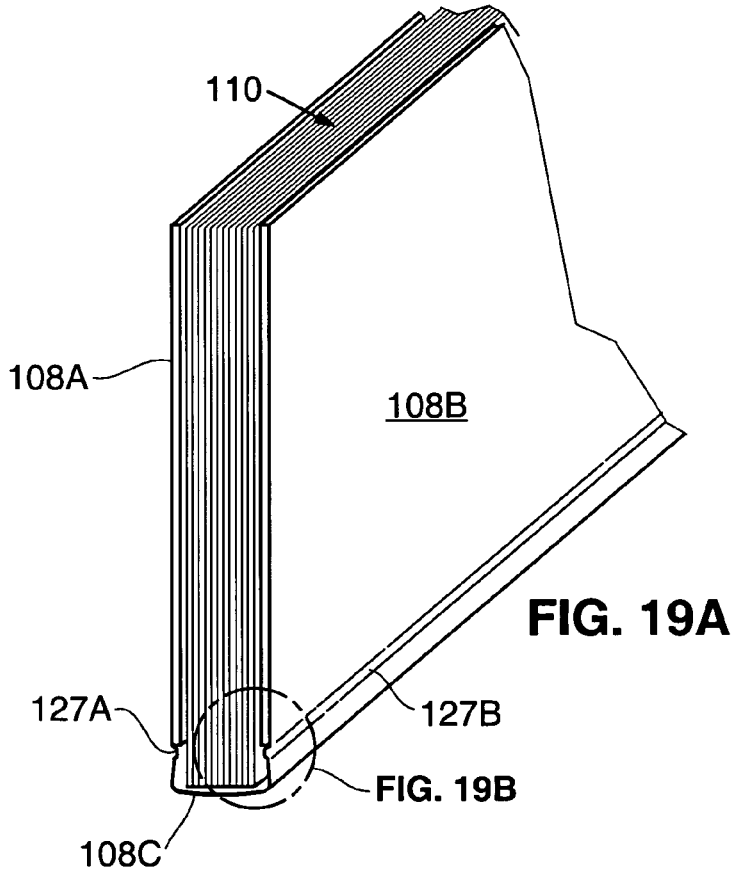
FIGS. 19A and 19B are perspective views of portions of the completed book.
Figure 19B:
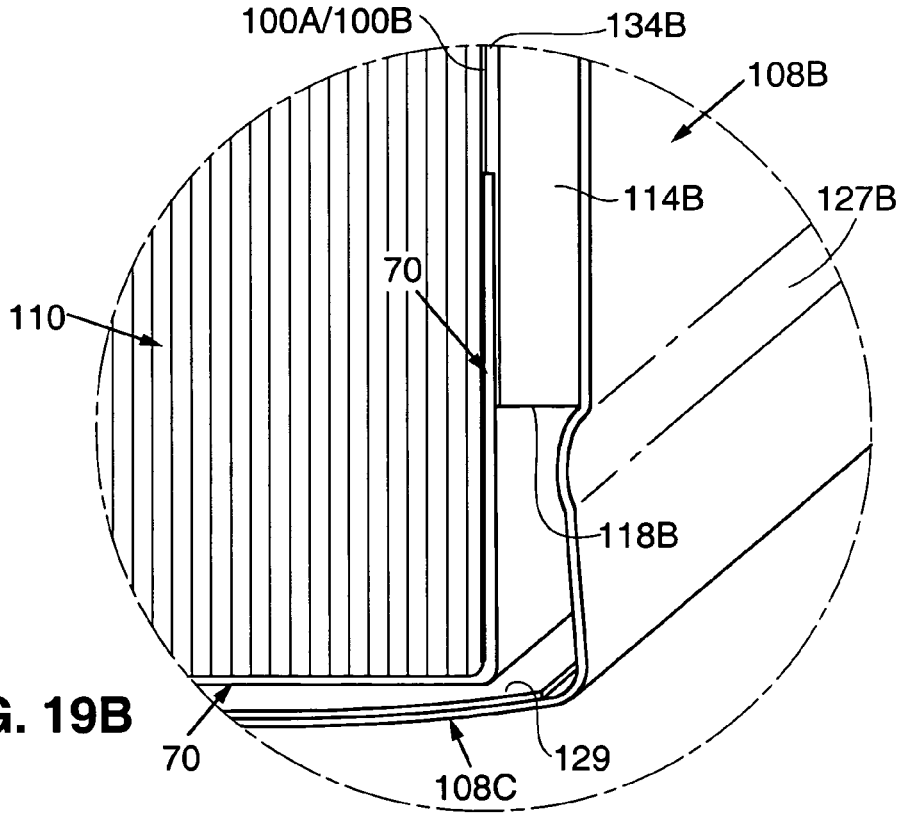
Figure 20:
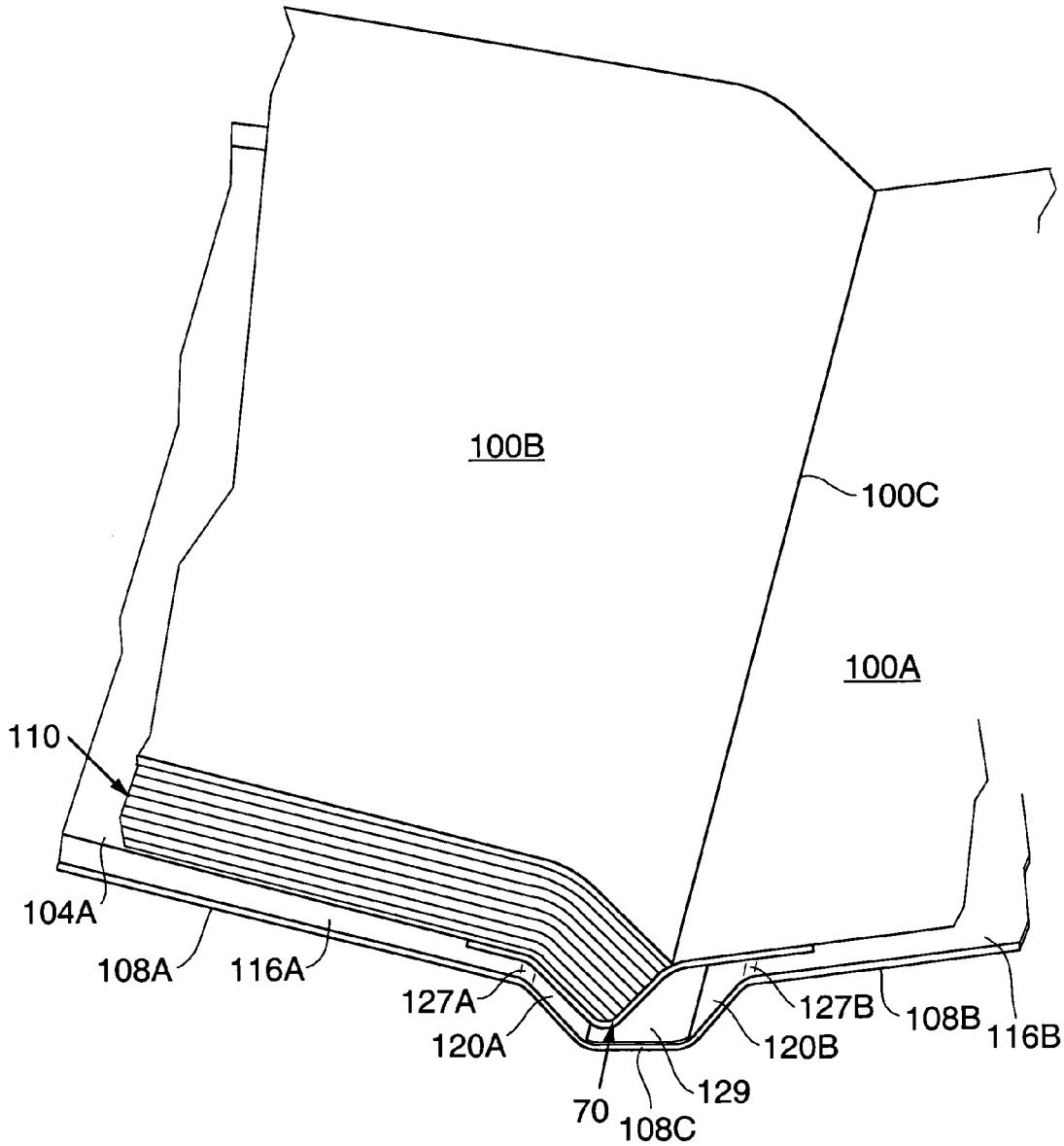
FIG. 20 is a perspective broken view of the completed book shown in an open position.

FIGS. 19A and 19B show the completed book in a closed position and FIG. 20 shows the book in an opened position, at the last page of the book, so that folded liner sheets 100A and 100B are depicted. Sheet 100A is secured to hardcover section 108B by way of adhesive 134B and sheet 104A at the front of the book (not depicted) is secured to hardcover section 108A by adhesive 134A. The region between the spine element 70 and the spine region 108C is not attached so that, when the book is opened as shown in FIG. 20, the spine region 122 and overlying slightly rigid fabric strip 129 does not attempt to fold with the spine element 70. Thus, the book will lay flat when opened and will not tend to fold shut. Further, the spine region 108C will not distort when the book is opened to the same degree it would if the spine region 108C was attached to the book edge. As previously noted, fabric strip 129 is positioned in the spine region intermediate the gutter regions 120A and 120B (FIG. 13) so as to hold the shape of the spine region 108C when the book is opened and closed. Fold lines 127A and 127B are formed naturally in the membrane 116 in the regions near the edges 118A and 118B of the cover boards thereby further enhancing the appearance of the final product.

Figure 21A:
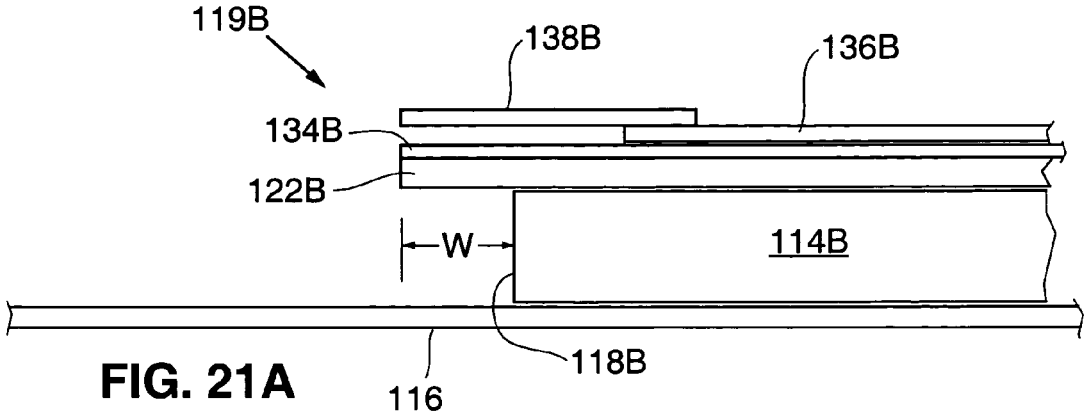
FIGS. 21A-21C depict a further embodiment of a hardcover assembly.
Figure 21B:
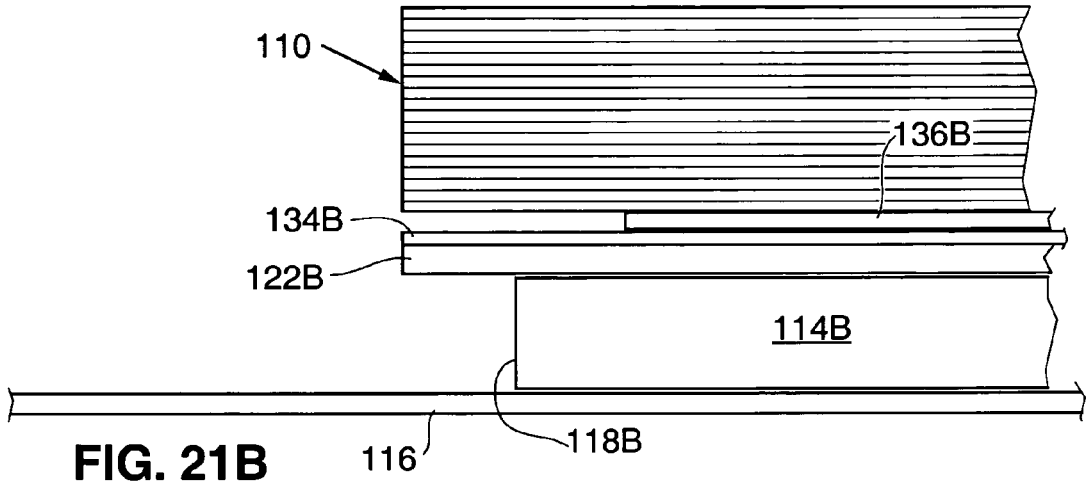
Figure 21C:
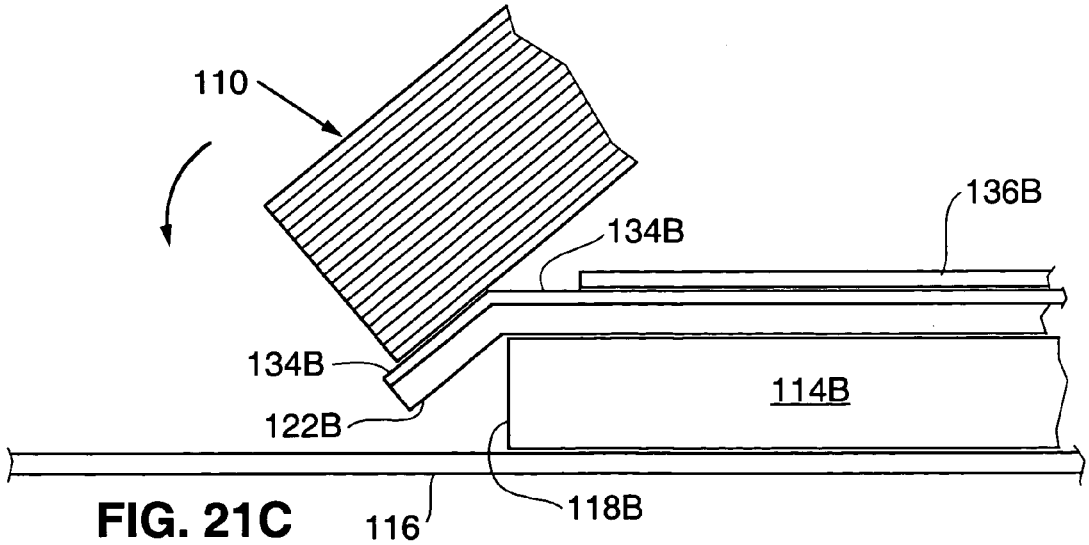
Figure 22:
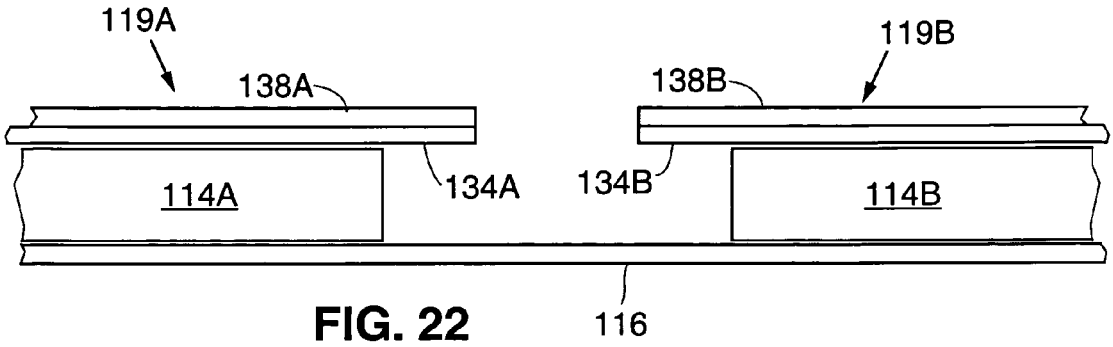
FIG. 22 depicts the further embodiment of the subject hardcover assembly.

Referring back to FIG. 18E, when the user lifts up the free edge of stack 110 so as to permit the upper release liner 136B to be removed, there may be a tendency for users to rotate the entire stack about the edge of the stack so as to expose the upper major release liner 136B for removal. This rotation, which is actually not necessary to expose the release liner, tends to cause the stack to be lifted up from the narrow strip of adhesive 134B so that the stack becomes separated from the adhesive thereby destroying the desired placement of the stack on the hardcover section 108B. This problem can be largely eliminated by dimensioning the pressure sensitive adhesive sheet structure (FIG. 13) so that the edge of the structure extends past the edge 118B of cover board 114B by a small amount W, as shown in FIG. 21A. FIG. 21A, along with FIGS. 21B and 21C, are schematic in nature for purposes of illustration and are not drawn to scale. The value of W is preferably about ⅜ of an inch, and should be at least 1/16 of an inch.

FIG. 21B, which generally corresponds to FIG. 18D of the binding sequence, shows that stack 110 positioned on the adhesive sheet structure 119B, with the minor release liner 138B removed. Although not shown in FIG. 21B due to the exaggerated thickness of release liner 136B, after the user has pressed down on the edge of stack 110, as shown in FIG. 18D, the stack will come into contact that portion of the exposed pressure sensitive adhesive 134B disposed above cover board 114B, thereby attaching the stack to the hardcover section 108B with the proper orientation. As previously noted, in order to provide access to the major release liner 136B, it is preferred that the user lift, that is fold up, only the outer edge of the stack 110, as shown in FIG. 18E, with the spine region of the stack remaining relatively horizontal. However, there is a tendency in some cased to rotate the stack 110 as shown in FIG. 21C, with such rotation tending to cause the stack to separate from the exposed adhesive 134B thereby disrupting the position of the stack relative to the hardcover section 108B.

As can be seen in FIG. 21C, such rotation will cause the stack to come into contact with the cantilevered portion of exposed adhesive 134B, that portion having dimension W in FIG. 21A. Although the adhesive 134B is supported in this region only by the rigidity of sheet 122B, the adhesive is sufficiently aggressive to cause the stack to adhere when rotation takes place. This adhering is adequate to keep the stack 110 sufficiently secured to the hardcover section 108B so as to maintain the desired orientation when the user is removing the major release liner 136B as shown in FIG. 18E. For hardcover assemblies where the hardcover sections 108A and 108B are interchangeable (either section could be the front or back book cover), it is preferable to provide both the extension of sheet 122B and adhesive 134B shown in FIG. 21A for sheet structure 119B and a corresponding extension for sheet 122A and adhesive 134A for sheet structure 119A, as shown in FIG. 13.

Figure 23:
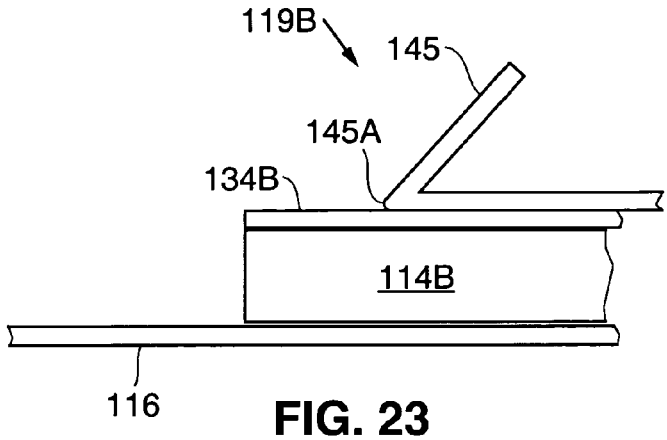
FIG. 23 depicts a still further embodiment of a hardcover assembly.
Figure 24:
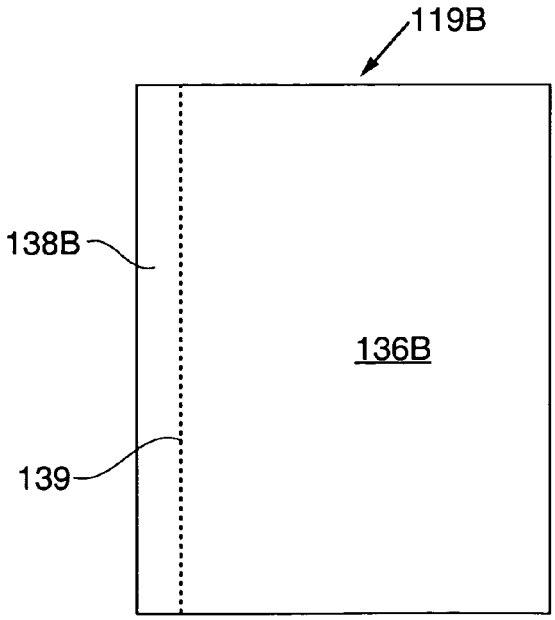
FIG. 24 show an alternative embodiment of the release liners used in the hardcover assembly.

Also, it would be possible to have major and minor release liners, such as liners 138B and 136B, formed from one sheet, but separated by perforations 139 as shown in FIG. 24. A user would then separate the minor release liner 138B from the major release liner 136B by simply tearing the sheet along the perforations. In addition, it would be possible to use a single release liner for each respective cover section 108A and 108B which covered the entire surface of the pressure sensitive adhesive 134A and 134B. FIG. 23 shows, in schematic form, the single release liner 145 as part of adhesive sheet structure 119B (the bottom sheet 122B is not shown). At the step which corresponds to FIG. 18B, the user folds the release liner 145 at fold line 145A over on itself to expose a narrow strip of adhesive 134B near the spine as shown in FIG. 23. The user then places the stack 110 on the folded release liner, similar to the step shown in FIG. 18C and forces the stack 110 down on the exposed adhesive, similar to the step shown in FIG. 18D. The stack 110 is then resting on the exposed adhesive and the folded release liner 145. The user then lifts the edge of the stack and removes the folded release liner 145 in a manner similar to the removal of liner 136B shown in FIG. 18E. A similar folding step can be carried out in connection with the step shown in FIG. 18H in connection with release liner 136A. This approach is not preferred since the user has to carry out the additional folding steps.

Figure 25:
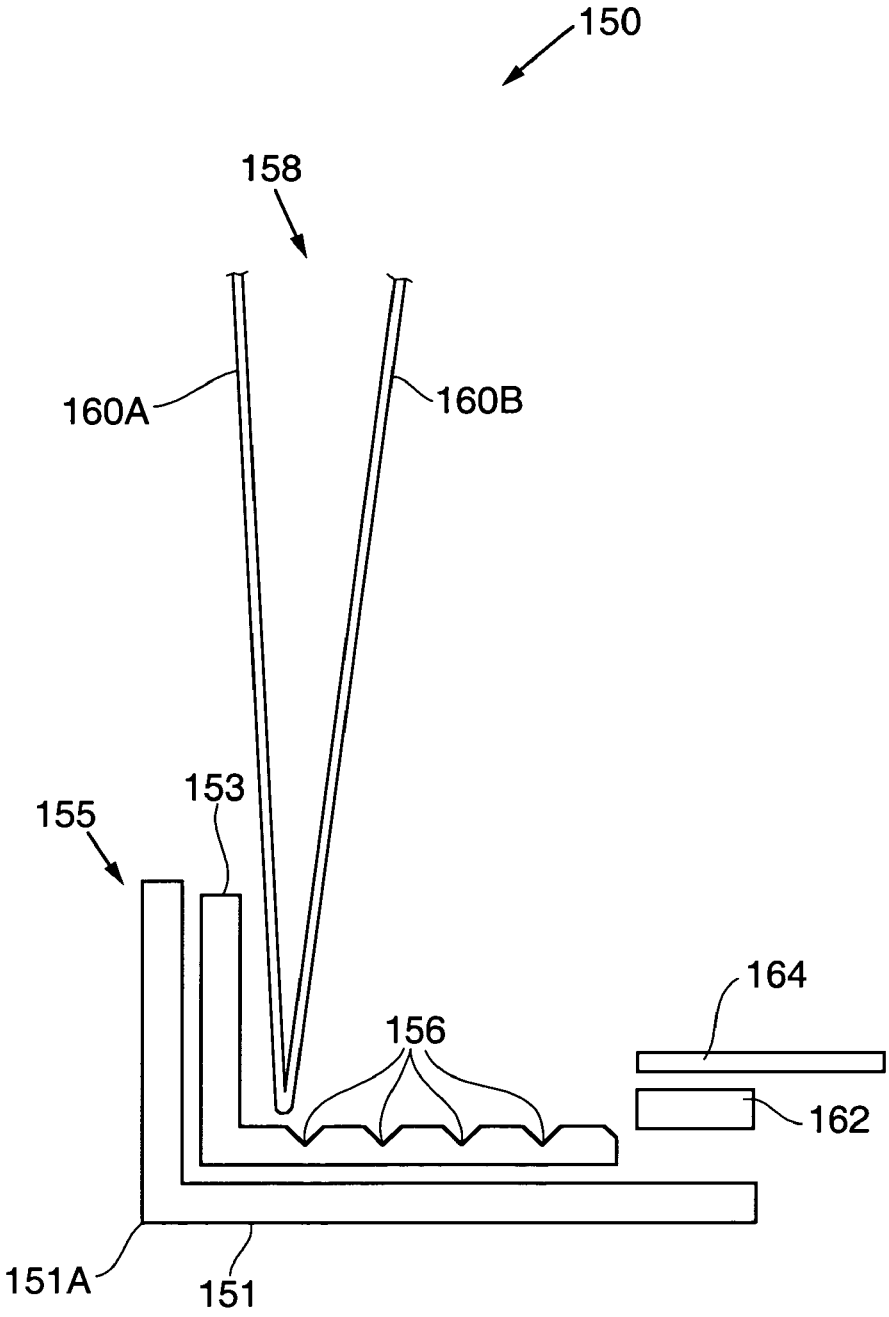
FIG. 25 is an elevational view of a further embodiment of the subject binding apparatus.

A still further embodiment 150 of the subject invention is shown in FIG. 25 in exploded form. This embodiment of the binding apparatus can be used in combination with a conventional folded end sheet. Further, this embodiment is intended to be finished in a hardcover assembly, similar to assembly 108 of FIG. 13.

Referring to the drawings, a folded cover element 158 is included, formed from a folded sheet of heavy paper such as 80 lb. Bristol velum. The folded cover element 158 includes an inner half 160B and an outer half 160A. A spine element 155 is provided which includes a substrate 151, similar to substrate 72 (FIG. 6) of the earlier-described embodiment. Substrate 151. supports a heat-activated adhesive 153, similar to adhesive 74. Adhesive 153 is provided with spaced apart grooves 156, similar to grooves 74A of the earlier embodiment. Sheet 160A of the folded cover element 158 is secured to the spine element 154 by way of adhesive 153.

Although not required, it is preferred that spine element 155 be pre-folded at point 151A to assist in assembly of the bound book. As shown in FIG. 25, the vertical component of the spine element 155, the portion that is attached to the folded cover element 158, it typically 0.25 inches. The horizontal component of the spine element, which is typically 1.25 inches, will accommodate stacks up to 1.0 inches. In the event stacks of even greater width are to be bound, the horizontal component can be increased, but this will result in some degradation in the appearance of the bound book. In order to improve the appearance of the bound books for wide stacks, binding structures having wider horizontal components can be used. The disadvantage, of course, is the need to maintain an inventory of different sized binding apparatus. In that the vertical component of the adhesive 153 will not be folded, there is no requirement that this portion of the adhesive be provided with grooves 156.

A strip of pressure sensitive adhesive 162, similar in composition and thickness to adhesive 63 of earlier-described embodiment, extends along the longitudinal edge of the spine element 155. Adhesive 162 is covered by a release liner 164, similar in composition to release liner 64 of the earlier embodiment.

Figure 26:
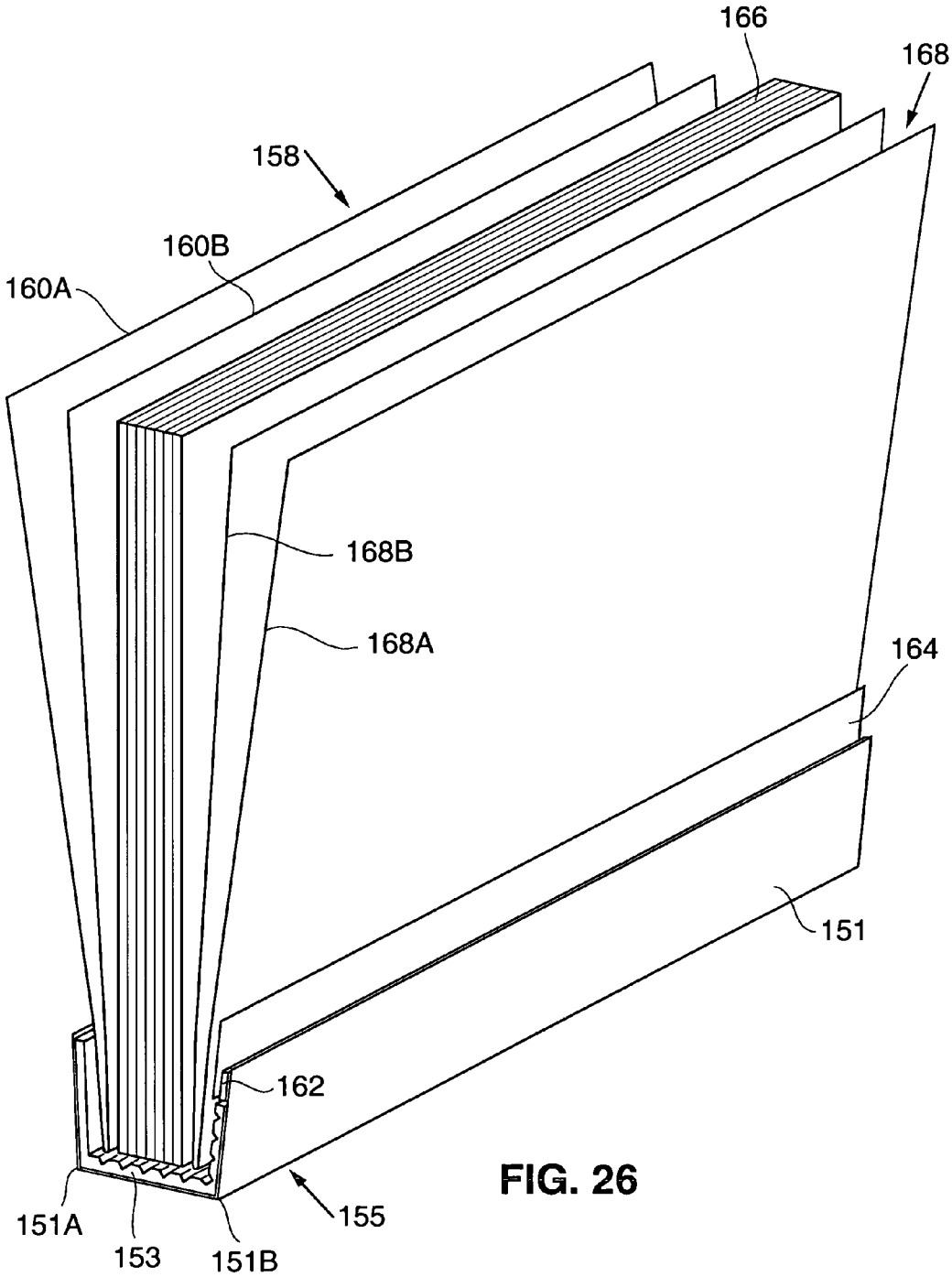
FIG. 26 is a perspective view of the FIG. 25 embodiment showing the subject apparatus partially applied to a stack of sheets to be bound.

The manner in which the FIG. 25 embodiment 150 of the subject binding apparatus is used will now be described. Reference is also made to FIG. 26 that shows the partially assembled book. Neither FIG. 25 nor FIG. 26 is drawn to scale, with both depicting a slightly exploded view for purposes of clarity. First, the binding apparatus is positioned on a guide apparatus similar to apparatus 78 of FIG. 12A. The folded cover element is positioned on the work surface 78A of the guide apparatus, with the spine section 155 to the user's right. The two respective edges of the folded cover element 158 are positioned abutting respective wall members 78B and 78C of the guide apparatus, in a manner similar to folded outer sheets 100A and 100B of the earlier embodiment. Next, a stack 166 (FIG. 26) of sheets to be bound is positioned over the folded cover section, similar to stack 80 of FIG. 12C. The respective edges of the stack are positioned abutting respective wall members 78B and 78C so that the edges of the stack will be aligned with the edges of the folded cover element. The user then places a conventional folded end sheet 168 (FIG. 26) on the stack, with the fold positioned adjacent the spine element 150. End sheet 168 is preferably made of heavy paper such as 80 lb. Bristol vellum. While supporting the stack with one hand as shown in FIG. 12G, the user then tightly wraps the spine section 155 around the edge of the stack 166, thereby causing a second fold 151B to be formed in the spine section. FIG. 26 shows that binder apparatus and stack at this point of the assembly.

The user then removes the release liner 164, similar to the step depicted in FIG. 12F, so as to expose adhesive 162. The user then presses the exposed adhesive 162 against sheet 168A of the folded end sheet 168. This will secure that stack 166 and the binding apparatus together. The assembly is then carefully placed in a heating unit 88 as shown in FIG. 8K so as to activate adhesive 153 thereby binding the sheets of the stack together and to the substrate 151. Pressure sensitive adhesive 162 provides two primary functions. First, the adhesive secures the folded substrate 151 in position prior to application of heat by the heating unit. Further, since the heating unit heating element 90 (FIG. 9) applies heat only to the lower surface of the binding apparatus, the adhesive 153 disposed above fold line 151B of FIG. 26 will not be heated and thus will not function to attach that part of the substrate 151 above the fold line to sheet 168A. (This is not an issue with folded cover element 158 since sheet 160B is secured by adhesive 153 when the binding apparatus is manufactured.) Thus, adhesive 162 operates to secure that part of substrate 151 above fold line 151B to the folded end sheet. Although not preferred, if the user is careful in placement of the assembly in the heating unit after folding, the adhesive 162 need not be used to hold the assembly together prior to heating. In that event, the release liner 164 need not be removed until after heating is completed so that the primary function of the adhesive is only to secure the substrate to the end sheet 168A.

At this point, once the assembly has cooled, a hard cover assembly can be added in essentially the same manner as previously described in connection with FIGS. 18A through 18M.

The FIG. 25 embodiment can be modified for use in those applications where a hard cover assembly will not be used. In that event, the folded cover element 158 is replaced by a single sheet, similar in location to sheet 160A, but not part of a folded cover element. The single sheet, which is typically heavy paper such as Bristol vellum, 80 lb., can be preprinted with title information and the like. The other folded end sheet 168 shown in FIG. 26 is also replaced with a single sheet, also typically made of heavy paper. The end sheet of the stack 166 to be bound could also perform this function, although it is preferable that heavy paper be used. The process for binding a stack is carried out in essentially the same manner as just described in connection with the FIG. 25 embodiment except, of course, no hard cover assembly is used.

Figure 27:
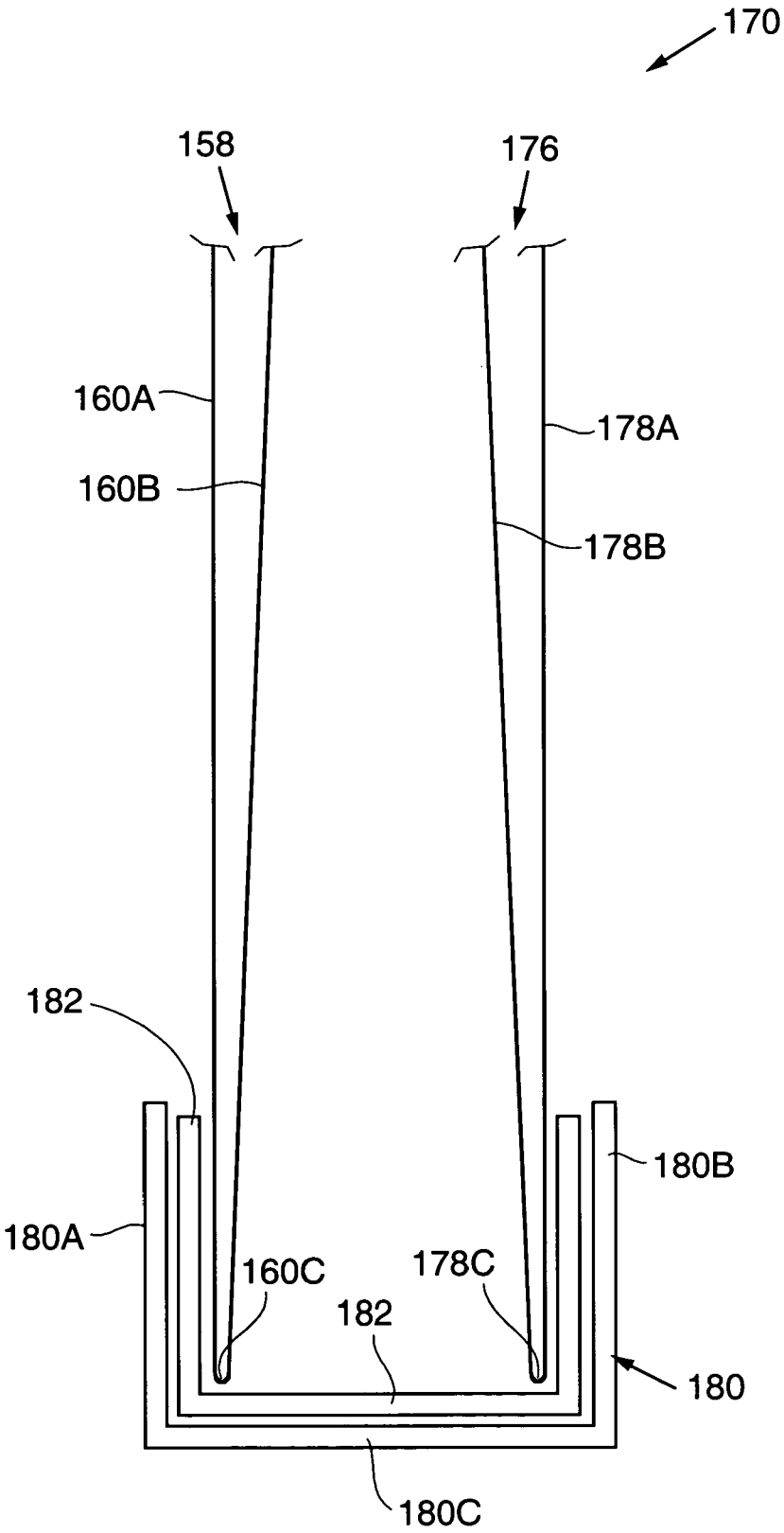
FIG. 27 is an elevational view of a still further embodiment of the present invention.

A still further embodiment 170 of the subject binding apparatus can be seen in FIG. 27, with FIG. 27 showing a slightly exploded view for purposes of clarity. This embodiment is advantageous in that it is easy to use, especially when a large number of similar sized stacks are to be bound. Referring to the drawing, embodiment 170 includes a substrate 180 and an overlying layer of heat activated adhesive 182 disposed over the substrate. The substrate and adhesive can be fabricated from the same materials used in the FIG. 25 embodiment. Preferably, the substrate 180 and adhesive layer 182 are pre-folded during manufacture to a U shape. A first folded cover element 158 includes sheets 160A and 160B separated by a fold 160C. Outer sheet 160A of cover element 158 is secured to one edge of substrate 180, preferably to substrate section 160A by way of the adhesive layer 182. Substrate section 160A is secured during manufacture to the substrate by way of adhesive 182. Similarly, a second cover element 176 is secured to the opposite edge of substrate 180 during manufacture. In particular, substrate section 180B is secured to outer sheet 178A by adhesive 182. Folded end sheets 160A, 160B, 178A and 178B have the same dimensions as the sheets of the stack to be bound.

When binding a stack of sheets using the FIG. 27 book binding apparatus 170, the user first selects a book binding apparatus of appropriate dimensions. In particular, the apparatus 170 should be selected such that the length of substrate section 180C is at least as long at the thickness of the stack, but preferably no more than 125% greater. Stated differently, the stack width should be at least 80% of the length of substrate section 180C. The user first positions the stack to be bound on adhesive layer 182, intermediate the two folded cover elements 158 and 176. Since the binding apparatus 170 is pre-folded, no folding is required. The stack should coincide with the outer and inner end sheets 160A, 160B, 178A and 178B. Next, the assembly is positioned on the heating unit 88 for approximately, 45 seconds. This will cause adhesive 182 to become molten. The assembly is then removed from the heating unit 88 and permitted to cool thereby resulting in a bound book. A hardcover assembly 108 is then attached to the bound book in essentially the same manner as previously described in connection with FIGS. 18A though 18M. The resultant bound book with hardcover is similar to the book shown in FIG. 20, with, for example, outer and inner sheets 100A and 100B corresponding to outer and inner sheets 178A and 178B, and fold 100C corresponding to fold 178C of the FIG. 27 embodiment.

The ease of use of the FIG. 27 embodiment is somewhat offset by the fact that, if the capability of binding stacks of widely varying thickness is needed, it will be necessary to maintain an inventory of book binder apparatus. The book binding apparatus are preferably manufactured in sizes starting at a substrate section 180C width of 0.080 inches and increasing in 0.080-inch increments.

Thus, a novel method of binding a book, either a soft cover and a hardcover book, has been disclosed. Although various embodiments of the present invention has been described in some detail, it is to be understood that certain changes could be made by those skilled in the art without departing from the scope of the invention as defined by the appended claims. By way of example, although various dimensions have been set forth for binding 8½ by 11 inch stacks, these dimensions can be adjusted to accommodate stacks of other sizes.

The invention claimed is:

1. A book binding apparatus for binding a stack of sheets, said apparatus comprising:

a first cover element including a first cover section having dimensions that generally correspond to dimensions of the sheets, with said first cover section being disposed substantially exclusively in a single plane;

a first section of pressure sensitive adhesive disposed along a free first edge of the first cover section;

a first release liner disposed over the first section of pressure sensitive adhesive;

a flap member attached to the first cover section and pivotable at a first location along the first cover section, with the first location being displaced from the first edge of the first cover section, with said flap member extending substantially along a full length the first edge of the first cover section and with at least a portion of the first section of pressure sensitive adhesive being disposed intermediate the first location and the first edge;

a second section of pressure sensitive adhesive disposed on a surface of said flap member; and a second release liner disposed over said second section of pressure sensitive adhesive, with said flap member being movable between a closed position where the first release liner can contact said second release liner and an open position where the flap member is positioned away from said first release liner.

2. The book binding apparatus of claim 1 further including:

a second cover element comprising a second cover section having dimensions that generally correspond to dimensions of the sheets, with said second cover section being disposed substantially exclusively in a single plane; and an elongated spine element having a longitudinal first edge attached to an edge of the second cover section and a free longitudinal second edge to be secured by the first section of pressure sensitive adhesive of the first cover section, with the spine element including a substrate and an adhesive matrix of heat activated adhesive disposed on the substrate.

3. The book binding apparatus of claim 2 wherein the adhesive matrix defines a multiplicity of spaced apart longitudinal grooves that facilitate folding of the spine element.

4. A method of binding a stack of sheets comprising;

providing a first cover element which includes a first cover section and an elongated spine element having a first longitudinal edge attached to an edge of the first cover section and a free second longitudinal edge, with the spine element including a heat activated adhesive matrix;

providing a second cover element which includes a second cover section and a flap member attached to the second cover section, with the flap member being movable between an open and a closed position;

positioning the stack of sheets intermediate the first and second cover sections;

folding the spine element around an edge of the stack of sheets so that the adhesive matrix is facing an edge of the stack of sheets;

subsequent to the folding, securing the spine element to the second cover section, with the second longitudinal edge being disposed intermediate the second cover section and the flap member; and subsequent to said folding, applying heat to the spine element so that molten heat activated adhesive contacts the edge of the stack.

5. The method of claim 4 wherein the securing is carried out using pressure sensitive adhesive.

6. The method of claim 5 wherein the second cover element includes a first segment of pressure activated adhesive covered by a first release liner, with at least a portion of the first segment of pressure activated adhesive being disposed intermediate the second cover section and the flap member when the flap member is in the closed position and wherein the method further includes removing the first release liner and the securing includes pressing the spine element and the first segment of pressure activated adhesive together.

7. The method of claim 6 wherein the securing further includes moving the flap member to the closed position so as to cover at least a portion of the spine element.

8. The method of claim 7 wherein a second segment of pressure sensitive adhesive is disposed on an inner surface of the flap member intermediate the second cover section and the flap member when the flap member is in the closed position and wherein the moving of the flap member to the closed position causes the flap member to be secured to the at least a portion of the spine element.

9. The method of claim 8 wherein a second release liner is disposed over the second segment of pressure sensitive adhesive and wherein, prior to the moving the flap member to the closed position, removing the second release liner so as to expose the second segment of the pressure sensitive adhesive.

10. The method of claim 4 further including:

subsequent to the applying heat, permitting the molten heat activated adhesive to cool so as to produce a bound stack;

providing a hardcover assembly including first and second relatively rigid hardcover sections separated by a spine segment, with the first hardcover section including a first pressure sensitive adhesive layer;

exposing only a first portion of the first pressure sensitive adhesive layer to produce an exposed first portion of the first pressure sensitive adhesive layer;

positioning the bound stack and the first hardcover section so that the bound stack and the exposed first portion of the first pressure sensitive adhesive layer come into contact with one another;

exposing a second portion of the first pressure sensitive adhesive layer; and bringing the bound stack and the second portion of the first pressure sensitive adhesive layer into contact with one another.

11. The method of claim 10 wherein the second hardcover section of the hardcover assembly further includes a second pressure sensitive adhesive layer and wherein the method further includes:

exposing only a first portion of the second pressure sensitive adhesive layer so as to produce an exposed first portion of the second pressure sensitive adhesive layer;

positioning the bound stack and the second hardcover section so that the bound stack and the exposed first portion of the second pressure sensitive adhesive layer come into contact with one another;

exposing a second portion of the second pressure sensitive adhesive layer; and bringing the bound stack and the second portion of the second pressure sensitive adhesive layer into contact with one another.

12. A method of binding a stack of sheets including:

providing a first cover element which includes a first cover section and an elongated spine element having a first longitudinal edge attached to an edge of the first cover section, with the spine element including a heat activated adhesive matrix;

providing a second cover element which includes a second cover section;

positioning the stack of sheets intermediate the first and second cover sections;

folding the spine element around an edge of the stack of sheets so that the adhesive matrix is facing an edge of the stack of sheets;

subsequent to the folding, securing the spine element to the second cover section using pressure sensitive adhesive;

subsequent to the folding, applying heat to the spine element so that molten heat activated adhesive contacts the edge of the stack;

subsequent to the applying heat, permitting the molten heat activated adhesive to cool so as to produce a bound stack;

providing a hardcover assembly including first and second relatively rigid hardcover sections connected by an intermediate spine segment, with the first hardcover section including a covered first pressure sensitive adhesive layer;

exposing only a first portion of the first pressure sensitive adhesive layer;

positioning the bound stack and the first hardcover section so that the bound stack and the exposed first portion of the first pressure sensitive adhesive layer come into contact with one another;

exposing a second portion of the first pressure sensitive adhesive layer; and bringing the bound stack and the second portion of the first pressure sensitive adhesive layer into contact with one another.

13. The method of claim 12 wherein the second hardcover section of the hardcover assembly further includes a covered second pressure sensitive adhesive layer and wherein the method further includes:

exposing the second pressure sensitive adhesive layer; and positioning the bound stack and the second hardcover section so that the bound stack and the exposed second pressure sensitive adhesive layer come into contact with one another.

14. A method of binding a stack of sheets comprising:

providing a first cover element that includes a first cover section having dimensions that generally correspond to dimensions of the sheets and an elongated spine element having a longitudinal first edge attached to a first edge of the first cover section, with the spine element including a substrate and an adhesive matrix of heat activated adhesive disposed on the substrate;

providing a second cover element which includes a second cover section;

positioning the first cover element and the stack of sheets such that the first cover section is disposed adjacent a first side of the stack of sheets;

positioning the second cover element relative to the stack of sheets so that the second cover section is disposed adjacent a second side of the stack of sheets;

folding the spine element around an edge of the stack of sheets so that the adhesive matrix is facing the edge of the stack;

subsequent to the folding, securing a second longitudinal edge of the spine element, opposite the first longitudinal edge, to the second cover section;

subsequent to the folding, applying heat to the spine element so that molten heat activated adhesive contacts the edge of the stack;

cooling the heat activated adhesive so as to provide a bound stack;

providing a hardcover assembly including first and second relatively rigid hardcover sections connected by an intermediate spine segment, with the first hardcover section including a first pressure sensitive adhesive layer;

exposing only a first portion of the first pressure sensitive adhesive layer;

positioning the bound stack and the first hardcover section so that the bound stack comes in contact with the exposed first portion of the first pressure sensitive adhesive layer;

exposing a second portion of the first pressure sensitive adhesive layer; and bringing the bound stack and the second portion of the first pressure sensitive adhesive layer into contact with one another.

15. The method of claim 14 wherein the securing is carried out using a pressure sensitive adhesive.

16. The method of claim 15 wherein the pressure sensitive adhesive is disposed on the first cover element.

17. The method of claim 14 wherein the second cover element includes a pressure sensitive adhesive and a release liner disposed over the pressure sensitive adhesive and wherein the securing includes removing the release liner and forcing the second longitudinal edge of the spine element and the pressure sensitive adhesive into contact With one another.

* * * * *